US008911275B2

(12) United States Patent
Maddocks et al.

(10) Patent No.: US 8,911,275 B2
(45) Date of Patent: Dec. 16, 2014

(54) BUILDING ELEMENTS WITH SONIC ACTUATION

(75) Inventors: Richard J. Maddocks, Barrington, RI (US); Paul N. Paulson, Riverside, RI (US); Kevin Ka Fat Wong, Sham Shui Po (HK); Richard Kwok-wah Leung, Tai Po (HK); Winston Kim Wa Lee, MongKok (HK)

(73) Assignee: Hasbro, Inc., Pawtucket, RI (US)

( * ) Notice: Subject to any disclaimer, the term of this patent is extended or adjusted under 35 U.S.C. 154(b) by 275 days.

(21) Appl. No.: 13/477,944

(22) Filed: May 22, 2012

(65) Prior Publication Data

US 2013/0316610 A1 Nov. 28, 2013

(51) Int. Cl.
*A63H 33/04* (2006.01)
*A63H 33/08* (2006.01)

(52) U.S. Cl.
CPC ..... *A63H 33/042* (2013.01); *A63H 33/086* (2013.01)
USPC ..... 446/91

(58) Field of Classification Search
CPC ..... A63H 33/04; A63H 33/042; A63H 33/06; A63H 33/062; A63H 33/08; A63H 33/086; A63H 33/05; A63H 33/00
USPC ..... 446/81, 85, 91, 103, 108, 116, 120, 446/122, 397, 404
See application file for complete search history.

(56) References Cited

U.S. PATENT DOCUMENTS 853,730 A 5/1907 Pearson et al.
1,865,837 A 7/1932 Connor
1,951,051 A 3/1934 Gueydan
2,392,547 A 1/1946 Plebanek
2,400,261 A 5/1946 Plebanek
2,618,888 A 11/1952 Hoff
2,811,809 A 11/1957 Di Franco
3,196,580 A 7/1965 Rakestraw
3,463,495 A 8/1969 Ragnvald (Continued)

FOREIGN PATENT DOCUMENTS

CN 201854403 6/2011
EP 1460005 9/2004

OTHER PUBLICATIONS

Vibration Speaker's principles of Operation, before May 22, 2012, 2 pages, Namiki Precision Jewel Co., Ltd., www.namiki.net/product/vibration/speaker/tech.html.

(Continued)

*Primary Examiner* — Kurt Fernstrom
(74) *Attorney, Agent, or Firm* — DiBerardino McGovern IP Group LLC

(57) ABSTRACT

A toy construction system includes a plurality of interconnectable building elements; a control system that generates an electromagnetic signal; a vibration speaker including a moveable permanent magnet; and a support building element mechanically linked to the permanent magnet of the vibration speaker. The vibration speaker includes a coil that is moveable relative to the permanent magnet. One or more of the coil and the permanent magnet vibrate in a manner that is based on the electromagnetic signal. The vibration speaker also includes a sound producer that is mechanically linked to the coil to vibrate with the coil as the coil vibrates. The coil vibrates relative to the permanent magnet to produce an audible sound, and the permanent magnet vibrates to cause the support building element to vibrate and animate interconnectable building elements linked to the support building element.

28 Claims, 17 Drawing Sheets

(56) References Cited

U.S. PATENT DOCUMENTS

| | | | | |
|---|---|---|---|---|
| 3,588,107 | A | 6/1971 | Kupperman | |
| 3,841,636 | A | 10/1974 | Meyer | |
| 3,940,140 | A | 2/1976 | Meyer et al. | |
| 4,147,358 | A | 4/1979 | Erickson | |
| 4,169,335 | A | 10/1979 | Betancourt | |
| 4,219,957 | A | 9/1980 | Kakuta | |
| 4,524,437 | A * | 6/1985 | Koike | 369/67 |
| 5,040,319 | A | 8/1991 | Wang et al. | |
| 5,149,291 | A | 9/1992 | Di Franco et al. | |
| 5,162,009 | A | 11/1992 | Vaughn | |
| 5,528,697 | A | 6/1996 | Saito | |
| 5,679,047 | A | 10/1997 | Engel | |
| 6,211,775 | B1 | 4/2001 | Lee et al. | |
| 6,443,796 | B1 * | 9/2002 | Shackelford | 446/91 |
| 6,466,682 | B2 | 10/2002 | An | |
| 6,547,624 | B1 * | 4/2003 | Bojesen et al. | 446/85 |
| 6,585,553 | B1 * | 7/2003 | Fetridge et al. | 446/91 |
| 6,826,449 | B1 | 11/2004 | Abu-Taha | |
| 6,899,589 | B1 | 5/2005 | Lund et al. | |
| 7,471,801 | B2 * | 12/2008 | Hakansson | 381/326 |
| 7,708,615 | B2 | 5/2010 | Munch | |
| 8,213,644 | B2 * | 7/2012 | Choi | 381/151 |
| 8,498,433 | B1 | 7/2013 | Lund et al. | |
| 8,721,384 | B2 * | 5/2014 | Norman et al. | 446/75 |
| 2004/0077286 | A1 * | 4/2004 | Smith | 446/491 |
| 2006/0252340 | A1 | 11/2006 | Bach et al. | |
| 2007/0037476 | A1 | 2/2007 | Leslie | |
| 2008/0085654 | A1 | 4/2008 | Hoeting et al. | |
| 2009/0107772 | A1 | 4/2009 | Lund et al. | |
| 2009/0311941 | A1 | 12/2009 | Bickerton et al. | |
| 2011/0111671 | A1 | 5/2011 | Norman et al. | |

OTHER PUBLICATIONS

Extended European Search Report from European Patent Office in counterpart EP Application No. 13168712.1, dated Jan. 14, 2014, 10 pages.

* cited by examiner

1322

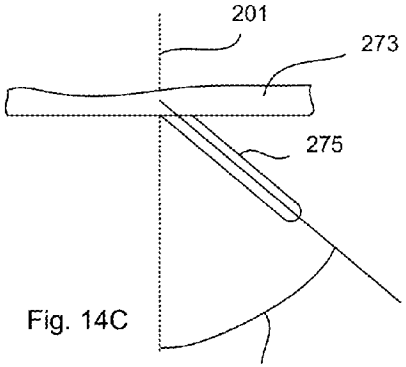
Fig. 14A
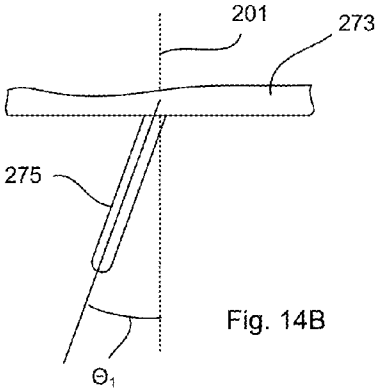
Fig. 14B
Fig. 14C
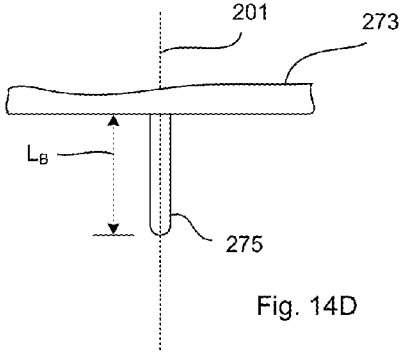
Fig. 14D
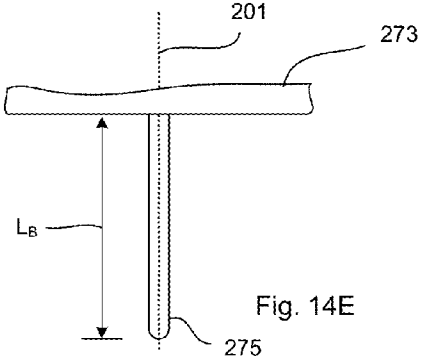
Fig. 14E
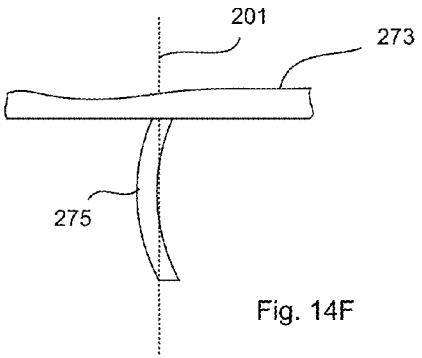
Fig. 14F

BUILDING ELEMENTS WITH SONIC ACTUATION

TECHNICAL FIELD

The disclosed subject matter relates to toy building elements having sonic actuation.

BACKGROUND

Children enjoy playing and interacting with toys that move. Typically, movement or animation in toys can be produced using a motor and a set of gears, shafts, and linkages mechanically coupled to the motor and to other parts of the toy.

Toy construction sets are made up of a plurality of building elements, which include coupling mechanisms such as studs or recesses of specific heights and placement to enable interconnection with other building elements.

SUMMARY

In some general aspects, a toy construction system includes a plurality of interconnectable building elements; a control system that generates an electromagnetic signal having one or more frequencies; a vibration speaker including a permanent magnet that is moveable; and a support building element that is mechanically linked to the permanent magnet of the vibration speaker. The vibration speaker includes a coil positioned near the permanent magnet and moveable relative to the permanent magnet, the coil configured to receive the electromagnetic signal from the control system such that one or more of the coil and the permanent magnet vibrate in a manner that is based on the one or more frequencies of the electromagnetic signal. The vibration speaker also includes a sound producer having a diaphragm that is mechanically linked to the coil to vibrate with the coil as the coil vibrates. The coil vibrates relative to the permanent magnet when the electromagnetic signal includes frequencies within a first frequency range, the vibration of the coil causing the diaphragm to vibrate and produce an audible sound, and the permanent magnet vibrates when the electromagnetic signal includes frequencies within a second frequency range, the vibration of the permanent magnet causing the support building element to vibrate.

Implementations can include one or more of the following features. For example, the toy construction system can also include a bristle module including a bristle pad positioned between a first building element and a second building element, the first building element connectable to the support building element, and the second building element can be connectable to the first building element. The vibration of the support building element causes the first building element to vibrate; the vibration of the first building element is converted into a unidirectional movement of the second building element by way of the bristle pad. The bristle pad can include a plurality of slantable bristles extending below a plate, the plate sized to fit within an opening of the second building element and the bristles resting on a top surface of the first building element. The plurality of slantable bristles can be arranged in a circular pattern to enable a circular unidirectional movement. The plurality of slantable bristles can be arranged in a linear pattern to enable a linear unidirectional movement.

The toy construction system can include a base building element on which the support building element and the vibration speaker are suspended to enable the support building element to freely vibrate relative to the base building element, wherein the vibration speaker is between the support building element and the base building element. The control system can be within an enclosure of the base building element.

In another general aspect, a toy includes a control system that generates a multi-frequency electromagnetic signal; a vibration speaker a permanent magnet that is moveable relative to a base; and a toy component that is mechanically linked to the permanent magnet. The vibration speaker also includes a coil positioned near the permanent magnet, the coil moveable relative to the permanent magnet, the coil configured to receive the multi-frequency electromagnetic signal from the control system such that both the coil and the permanent magnet vibrate at the same time in manners that are based on the frequencies of the multi-frequency electromagnetic signal. The vibration speaker also includes a sound producer including a diaphragm that is mechanically linked to the coil to move with the coil as the coil moves. The simultaneous vibration of the diaphragm and the permanent magnet causes the simultaneous movement of the toy component and the production of audible sound that complements the toy component movement.

In another general aspect, a device includes a base having a plurality of through holes; a cap that is moveable relative to the base along a first path away from or toward a neutral position and that is constrained relative to the base along a second path; and a set of slantable bristles extending through at least some of the through holes of the base at a first end and being mounted to the cap at a second end, the set of bristles extending along a neutral unslanted direction when the cap and the base are in the neutral position. Movement of the cap relative to the base along a first direction of the first path relative to the neutral position causes the bristles to slant in a first manner relative to the neutral direction and movement of the cap relative to the base along a second direction of the first path that is opposite to the first direction relative to the neutral position causes the bristles to slant in a second manner relative to the neutral direction.

Implementations can include one or more of the following features. For example, the device can also include a plate that is mechanically linked to the cap so that the plate moves as the cap moves relative to the base along the first path away from or toward the neutral position, wherein the bristles are connected to the plate at the second end. The plate can be mechanically linked to the cap when a peg of the cap is inserted into an opening of plate, the cross-sectional shape of the peg being complementary to the shape of the plate opening.

The first path can be a linear path and the second path can be a linear path that is perpendicular to the first path. The first path can be a circular path and the second path can be an axial path that is perpendicular to the first path.

The cap can include coupling mechanisms for connecting to building elements of a construction set. The cap can be connected to the base so that the cap has limited movement relative to the base along the second direction.

In other general aspects, a motion converter apparatus is used in a toy construction set that includes a plurality of distinctly designed building elements. The motion converter apparatus includes a first building element; a second building element; and a plurality of bristles. The first building element includes a first type of coupling mechanism for interconnecting with other building elements of the toy construction set; a first receiving surface; and a first connector. The second building element includes a second type of coupling mechanism for interconnecting with other building elements of the toy construction set; a second receiving surface; and a second connector that mates with the first connector and enables the second and first building elements to move relative to each other. The plurality of bristles extends from the second receiving surface toward the first receiving surface, with first ends of the bristles touching the first receiving surface and second ends of bristles constrained by the second receiving surface such that movement of the second receiving surface relative to the first receiving surface causes a slanting of the bristles.

Implementations can include one or more of the following features. For example, the plurality of bristles can include a top plate to which the second ends of the bristles are fixed, the top plate being fixed to the second receiving surface of the second building element.

The second ends of the bristles can be fixed to the second receiving surface of the second building element.

The second building element can be rotatable relative to the first building element about an axis defined by the first and second connectors. The bristles can be arranged about the axis of the first and second connectors and the bristles are slanted such that vibration of the first building element and the first receiving surface causes the plurality of bristles to rotate about the axis, which causes the second receiving surface and the second building element to rotate about the axis.

The second building element can be translatable relative to the first building element. The bristles can be slanted such that vibration of the first building element and the first receiving surface causes the bristles to translate along a lateral axis, which causes the second receiving surface and the second building element to translate along the lateral axis.

Further features and advantages will become more readily apparent from the following detailed description when taken in conjunction with the accompanying drawings.

DRAWING DESCRIPTION

The present disclosure is further described in the detailed description that follows, in reference to the noted drawings by way of non-limiting examples of exemplary embodiments, in which like reference numerals represent similar parts throughout the several views of the drawings, and wherein:

FIGS. 14A-14F are close-up side views of a bristle in a natural environment that can be used in the toy construction systems of FIGS. 1, 2A, 2B, 4A, 4B, 6A, 6B, 7A, 7B, and 8;

Figure 16:
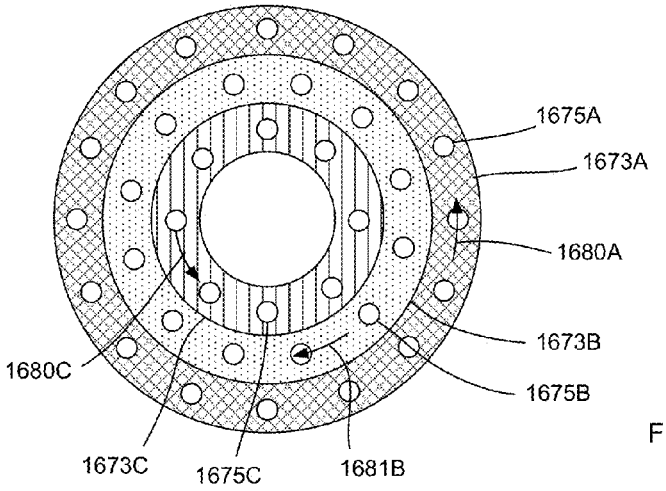
Figure 17:
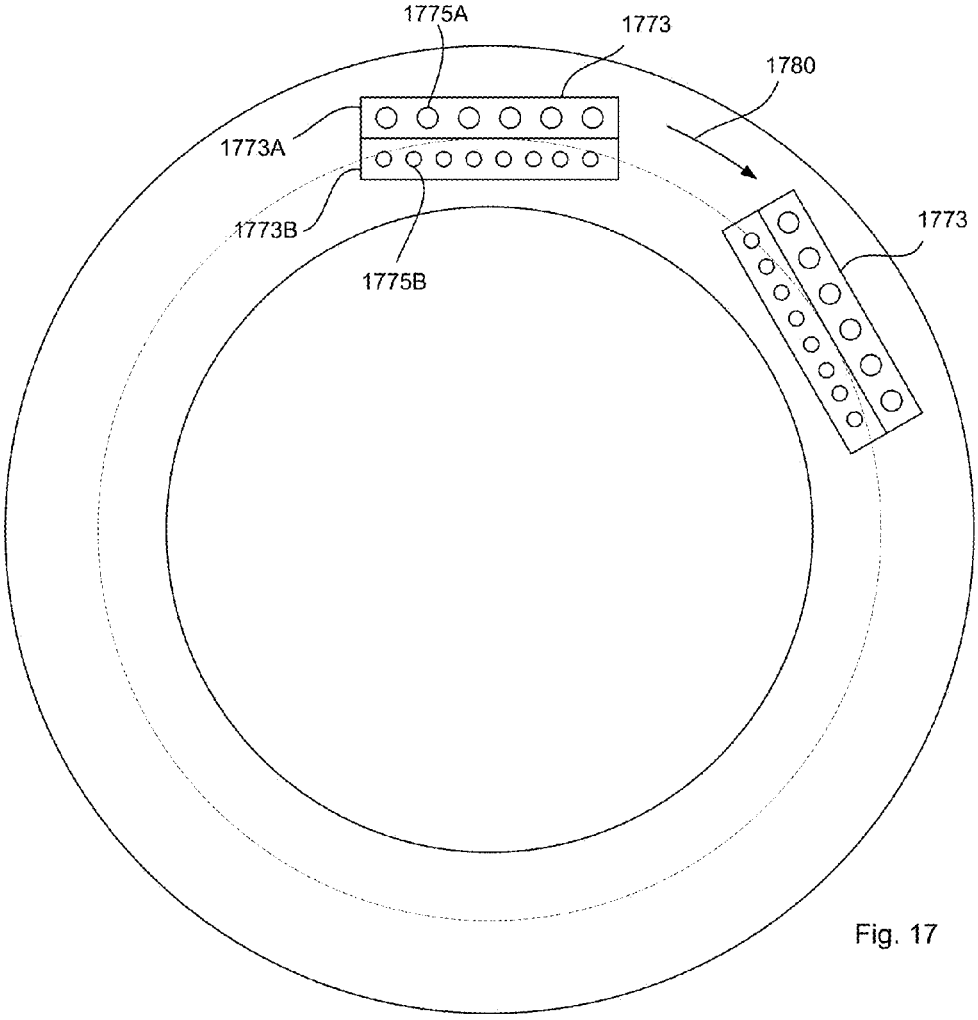

FIG. 16 is a bottom plan view of an exemplary circular bristle arrangement of a motion converter apparatus that can be used in the toy construction systems of FIGS. 1, 2A, 2B, 4A, 4B, 6A, 6B, 7A, 7B, and 8; and FIG. 17 is a bottom plan view of an exemplary rectangular bristle arrangement of a motion converter apparatus that can be used in the toy construction systems of FIGS. 1, 2A, 2B, 4A, 4B, 6A, 6B, 7A, 7B, and 8, and showing an exemplary motion imparted to the second element.

DESCRIPTION

The following description provides exemplary embodiments only, and is not intended to limit the scope, applicability, or configuration of the disclosure. Rather, the following description of the exemplary embodiments provides those skilled in the art with an enabling description for implementing one or more exemplary embodiments. Various changes can be made in the function and arrangement of the elements without departing from the spirit and scope of the invention as set forth in the appended claims.

Figure 1:
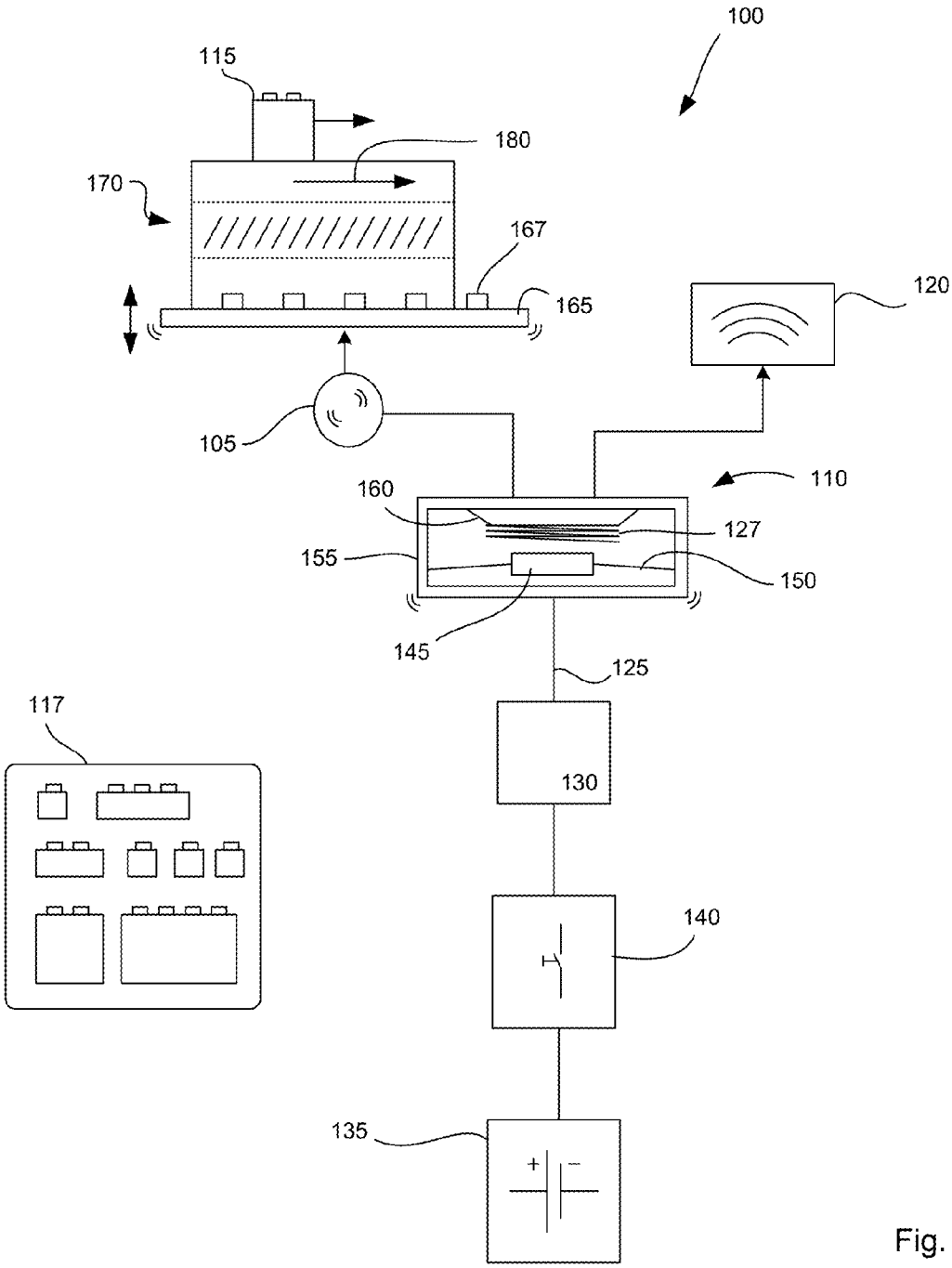
FIG. 1 is a block diagram of a toy construction system that uses a vibration speaker to produce both sound and tactile vibrations.

Referring to FIG. 1, a toy construction system 100 is designed to harness the tactile vibrations 105 produced from a vibration speaker 110 to animate one or more interconnectable building elements 115 of a construction set 117 while also being able to provide sound 120 from the vibration speaker 110. The sound 120 produced by the vibration speaker 110 can be synchronized with the animation of the building elements 115 to provide for more realistic play. The vibration speaker 110 can provide a cost-effective solution to provide both motion and sound in a compact design for controlling building elements and other components of construction sets. The construction sets therefore can be built with different configurations to provide different animations in combination with sound without requiring an additional vibrating mechanism or motor. Moreover, the vibration speaker 110 can be configured within a building element; and therefore can be repositioned within the construction set depending on the animation desired.

In particular, the vibration speaker 110 produces the tactile vibrations 105, the sound 120, or both the tactile vibrations 105 and the sound 120 depending on the frequency characteristics of an electromagnetic signal 125 that is input to a coil 127 within the speaker 110, the signal 125 being generated from a control system 130.

The control system 130 includes internal memory that can store information about components of the system 100, and a processing unit that accesses the internal memory. The control system 130 can also include an input/output device for communicating with other components, such as the arrangement of building elements 115 or other building elements of the construction set 117, or for communicating with users to enable users to input information to the control system 130. For example, an electrical connection can be connected to the control system 130 and implemented in any of the building elements of the construction set 117 or the arrangement of building elements 115 or to another component such as a base that houses the control system 130. The electrical connection can be a female socket that receives a signal from a male plug to enable users to create their own sound effects and mix animation frequencies that can be input through the male plug, through the female socket, and to the control system 130. The control system 130 can be configured to access information within internal memory housed in these other building elements and can output the signal 125 based on this accessed information.

The control system 130 receives energy from an energy source 135 (such as a battery) when one or more switches 140 are activated. The coil 127 generates a magnetic field that depends on the frequency characteristics of the signal 125; and it is the interaction of this generated magnetic field with a nearby permanent magnet 145 within the vibration speaker 110 that is adjusted to thereby produce the tactile vibrations 105, the sound 120, or both the tactile vibrations 105 and the sound 120.

The tactile vibrations 105 are produced by the motion of the permanent magnet 145, which is suspended by a suspension system 150 relative to a base 155 of the vibration speaker 110. The permanent magnet 145 gains kinetic energy most effectively (and therefore produces the greatest tactile vibrations) if a driving frequency of the signal 125 is below a predetermined tactile frequency value, the predetermined tactile frequency value depending on the design and types of materials used within the speaker 110 and also on the material and weight of the permanent magnet 145, which is the heaviest component of the vibration speaker 110. Thus, for a permanent magnet 145 made of ferrite and having a suspension system 150 made of metal, the predetermined tactile frequency value can be about 120 Hz; and the frequency range at which the tactile vibrations 105 are most efficiently produced can be about 70 Hz-120 Hz.

On the other hand, for driving frequencies within the signal 125 that are greater than an predetermined audible frequency value, the permanent magnet 145 is not able to gain kinetic energy as effectively, and there is very little relative motion between the permanent magnet 145 and the coil 127; in this situation, most of the kinetic energy is transferred to the coil 127, which moves and vibrates relative to the permanent magnet 145 due to the interaction of the generated magnetic field with the permanent magnet 145. A diaphragm 160 attached to the coil 127 moves and vibrates with the coil 127; and it is the vibration of the diaphragm 160 that causes the oscillation of pressure transmitted through the air adjacent the vibration speaker 110 to produce the sound 120. In one particular example in which the diaphragm 160 is made of Mylar™, the predetermined audible frequency value can be about 20 Hz, and the audible frequency range at which the diaphragm 160 efficiently vibrates can be about 20 Hz-20 kHz.

Thus, it is possible to provide an electromagnetic signal 125 that has frequency characteristics within both ranges to produce both tactile vibrations 105 and sound 120 from the vibration speaker 110. It is also possible to adjust the frequency characteristics to select one or the other of the tactile vibrations 105 and the sound 120 to output depending on the design of the building elements 115 and the animation desired. The electromagnetic signal 125 can include two sets of signals, one that is within a range of frequencies below the predetermined tactile frequency value and one that is within a range of frequencies above the predetermined audible frequency value; and these signals can be adjusted by the control system 130, as needed, to produce different sounds and animations in the building elements 115.

Importantly, the tactile vibrations 105 are not harnessed from the sound 120 or from the motion or vibration of the diaphragm 160 (and the coil 127), which produces the sound 120; rather, the tactile vibrations 105 are harnessed from the motion and vibration of the permanent magnet 145, and also the base 155, which moves because the permanent magnet 145 moves. Additionally, the tactile vibrations 105 are mechanically linked to the vibrations of objects (in this case, the magnet 145 or the base 155) while the sound 120 is produced from the oscillation of pressure in the compressible medium such as air due to the vibration of the diaphragm 160.

The tactile vibrations 105 produced by the vibration speaker 110 are mechanically transmitted to a support building element 165, which includes one or more coupling mechanisms 167 for enabling the support building element 165 to be interconnected with other building elements of the construction set 117. The support building element 165 can be designed as a platform building element 165 with a flat shape or can be an elongated or rounded building element with any suitable shape that can depend on the toy building built or the application of the vibrations. The toy construction system 100 also includes a motion converter apparatus 170 that converts the tactile vibrations 105 into a unidirectional motion 180, which is thereby transferred to the building elements 115 mechanically linked to the apparatus 170 to cause the building elements 115 to move along a unidirectional path defined by the motion 180. The unidirectional motion 180 can be a rotational motion in which objects travel along a path of a circle or a translatable motion in which objects travel along a linear path. The unidirectional motion 180 can be reversed to reverse the path of the building elements 115 by reversing a setting of the motion converter apparatus 170, as discussed below with respect to FIGS. 2A and 2B.

Figure 5A:
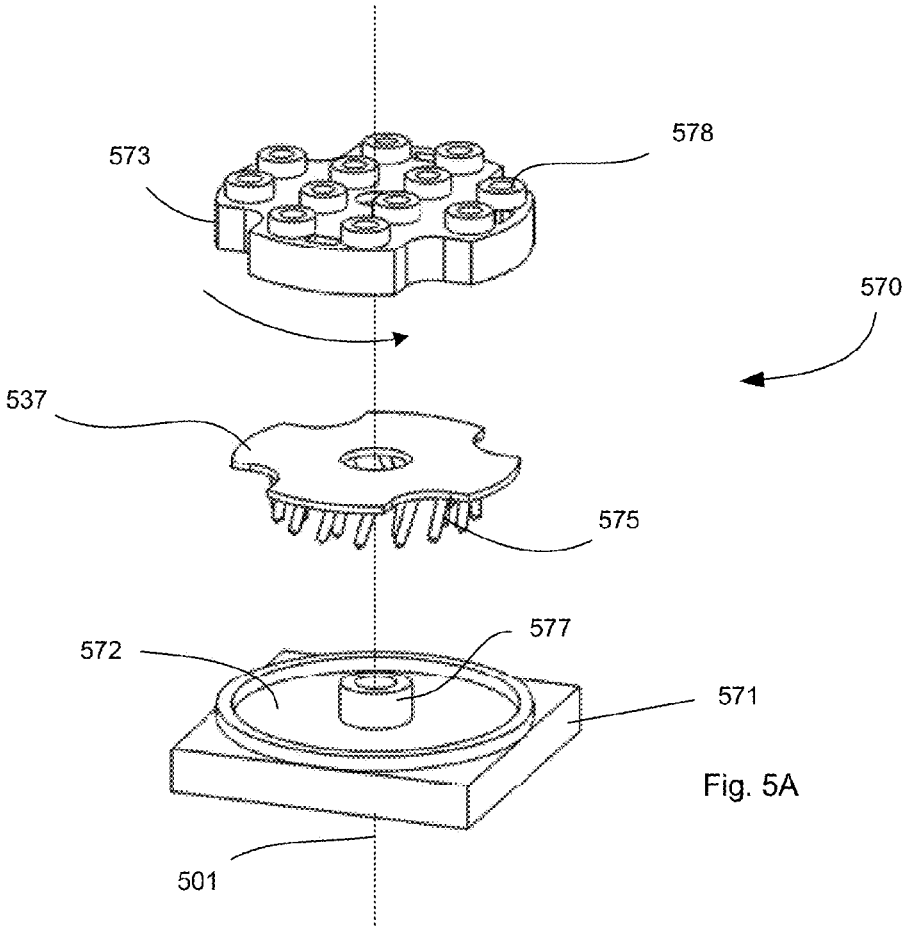
FIG. 5A is an exploded perspective view of a self-contained motion converter apparatus that can be used in the toy construction system of FIGS. 1, 2A, and 2B.
Figure 5B:
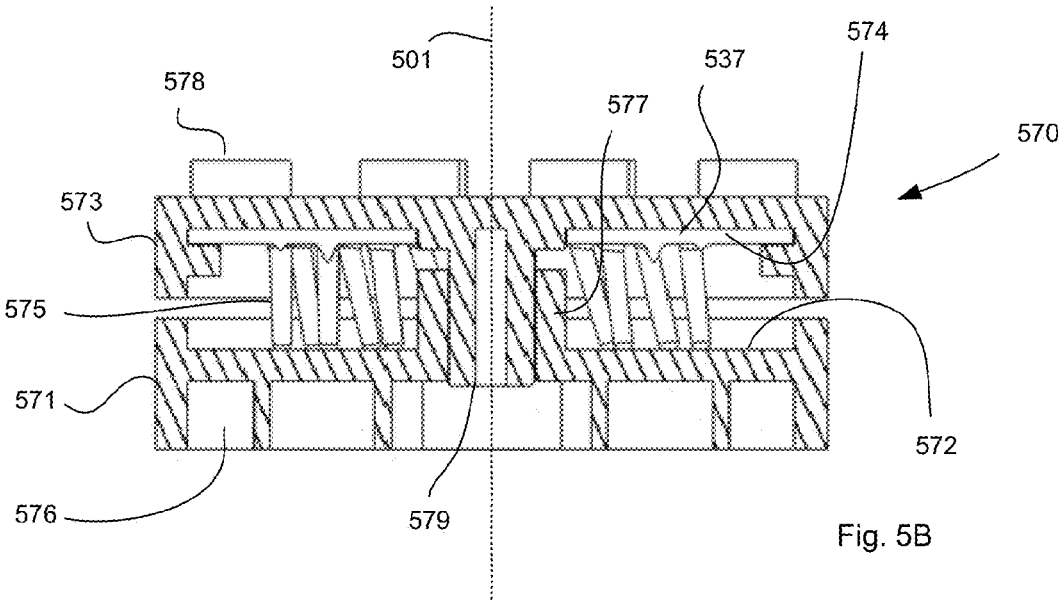
FIG. 5B is a side cross-sectional view of the motion converter apparatus of FIG. 5A.

As also discussed below, and as shown in FIGS. 5A and 5B, the motion converter apparatus 170 can be a self-contained apparatus in which all of the components of the apparatus 170 are within a single building element unit. Alternatively, the motion converter apparatus 170 can be made up of distinct components, which are described below.

The vibration speaker 110, the support building element 165, the control system 130, the one or more switches 140, and the energy source 135 can be separable components of the toy construction system 100. In some implementations, which are described below, the vibration speaker 110, the support building element 165, the control system 130, the one or more switches 140, and the energy source 135 are part of a self-contained apparatus, within a single building element unit.

Figure 2B:
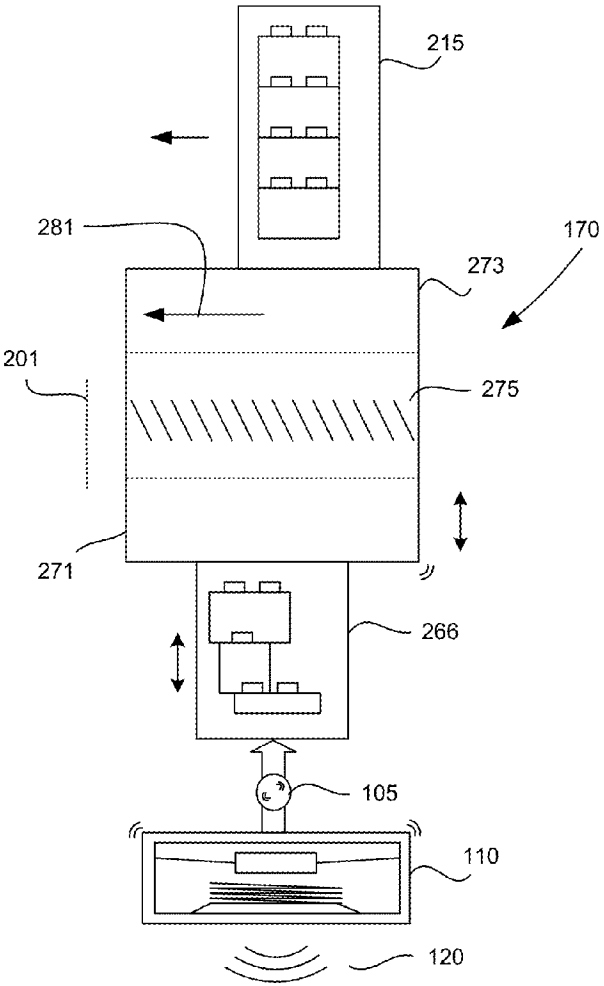
FIGS. 2A and 2B are block diagrams of exemplary toy construction systems.
Figure 2A:
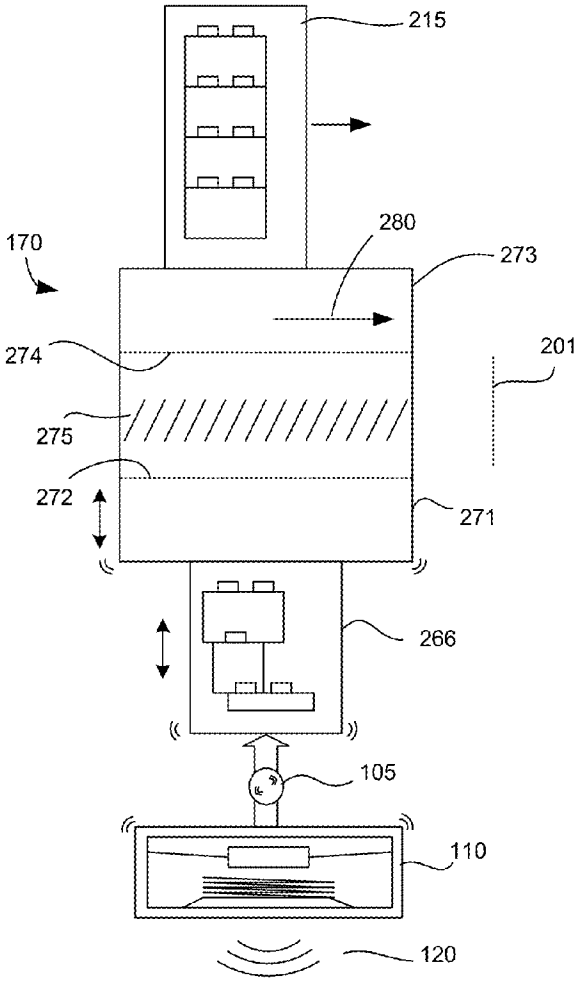

Referring also to FIG. 2A, an exemplary toy construction system 100 is shown in which the tactile vibrations 105 from the vibration speaker 110 can be mechanically transferred to an optional arrangement 266 of building elements that could include the support building element 165 described above. The tactile vibrations 105 can be mechanically transmitted through each of the building elements of the arrangement 266 to the motion converter apparatus 170, which converts the tactile vibrations 105 into a first unidirectional motion 280. The first unidirectional motion 280 is mechanically transferred to an arrangement 215 of building elements, which, in this example, are shown in a first arrangement to produce a first animation.

The motion converter apparatus 170 includes a first element 271 that is mechanically constrained by the motion of the tactile vibrations 105 (for example, through the arrangement 266) so that the first element 271 vibrates with the tactile vibrations 105. In some examples provided below, the first element 271 can be a building element that has coupling mechanisms that enable the first element 271 to be interconnected with other building elements of the toy construction set 117. The first element 271 includes a first receiving surface 272. The motion converter apparatus 170 also includes a second element 273 that includes a second receiving surface 274. The first element 271 and the second element 273 are moveable relative to each other. The second element 273 can be a building element that has coupling mechanisms that enable the second element 273 to be interconnected with other building elements of the toy construction set 117.

The motion converter apparatus 170 includes a set of slantable bristles 275 positioned between the second receiving surface 274 and the first receiving surface 272; the bristles 275 being slanted at a first angle relative to a neutral position 201. Each of the bristles 275 makes contact at its first end with the first receiving surface 272 such that the tactile vibrations 105 transmitted to the first element 215 are transmitted to the first ends of the bristles 275. The first ends of the bristles 275 are unconstrained and able to freely move and because of this, the bristles 275 can be considered to be slantable by an angle relative to the neutral position 201. The bristles 275 are set or fixed at a particular angle relative to the neutral position 201 while in a natural environment, which can be considered as the environment in which the bristles 275 are not in contact with, and therefore are not receiving any force from, the first element 271. Moreover, the second ends of the bristles 275 are constrained by the second receiving surface 274 so that as the second ends of the bristles 275 move, the second receiving surface 274 moves. Additional details about the geometry of the bristles and the arrangement of the bristles 275 are discussed below and with reference to FIGS. 14A-17.

The arrangement of the bristles 275 impacts the path of the unidirectional motion 280; thus, if the bristles 275 were arranged in a rectangular pattern, then the unidirectional motion 280 would be linear and if the bristles 275 were arranged in a circular pattern, then the unidirectional motion 280 would be circular. To enable the bending of the bristles 275, the bristles 275 are made of a soft, bendable, and non-magnetic material such as urethane or silicon. In some implementations, the bristles 275 are made using an injection molding process. Other processes for making the bristles 275 are possible. For example, the bristles 275 can be made with casting molds.

When the first element 271 vibrates, the slanted bristles 275 are forced to vibrate between bent shapes and the natural shapes of the bristles 275 when in the natural environment, and the amplitude of the vibration periodically bends the bristles 275 at the frequency of the vibration. As the bristles 275 snap back to their natural shapes from being bent, the bristles 275 are forced into the unidirectional motion 280; thus, the vibration is converted into the first unidirectional motion 280, and this motion depends on the angle at which the bristles 275 are slanted. The slanted bristles 275 move with the unidirectional motion 280 and cause the second element 273, which is constrained by the motion of the second ends of the bristles 275, to also move with the unidirectional motion 280. The unidirectional motion 280 of the second element 273 is mechanically transferred to the arrangement 215 to produce an animation. The animation of the arrangement 215 depends on the configuration, geometry, and types of building elements used in the arrangement 215.

Referring also to FIG. 2B, as mentioned above, the unidirectional motion can be reversed to reverse the path of the building elements 215 by reversing or changing a setting of the motion converter apparatus 170. In this example, the setting that can be reversed or changed is the angle at which the bristles 275 are slanted relative to a neutral position (which, in FIGS. 2A and 2B is indicated at line 201). Thus, in FIG. 2B, the bristles 275 are slanted at another angle (which is opposite to the angle at which the bristles 275 are slanted in FIG. 2A) relative to the neutral position 201. In this way, when the first element 271 vibrates, the slanted bristles 275 in FIG. 2B are forced to vibrate, and this vibration is converted into a second unidirectional motion 281 that depends on the angle at which the bristles 275 are slanted in FIG. 2B. The slanted bristles 275 that move with the second unidirectional motion 281 cause the second element 273 (which is constrained by the motion of the second ends of the bristles 275) to also move with the second unidirectional motion 281 along the second unidirectional path (which is opposite to the first unidirectional path). Thus, the arrangement 215 produces a second animation.

Figure 3A:
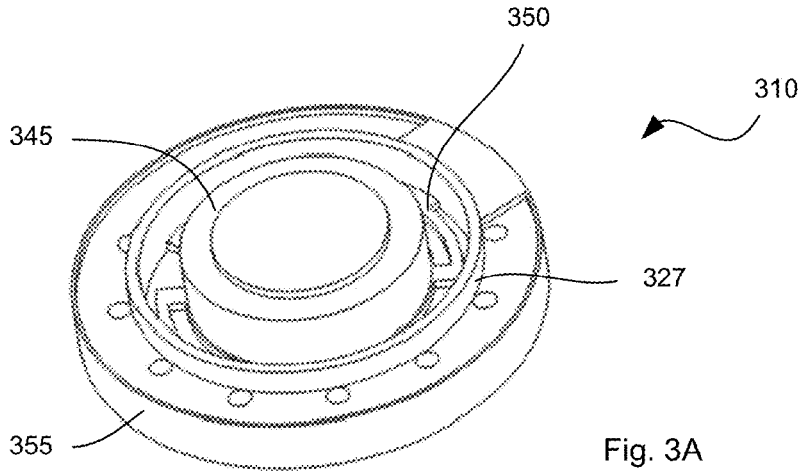
FIG. 3A is a perspective view of an exemplary vibration speaker that can be used in the toy construction systems of FIGS. 1, 2A, and 2B.
Figure 3B:
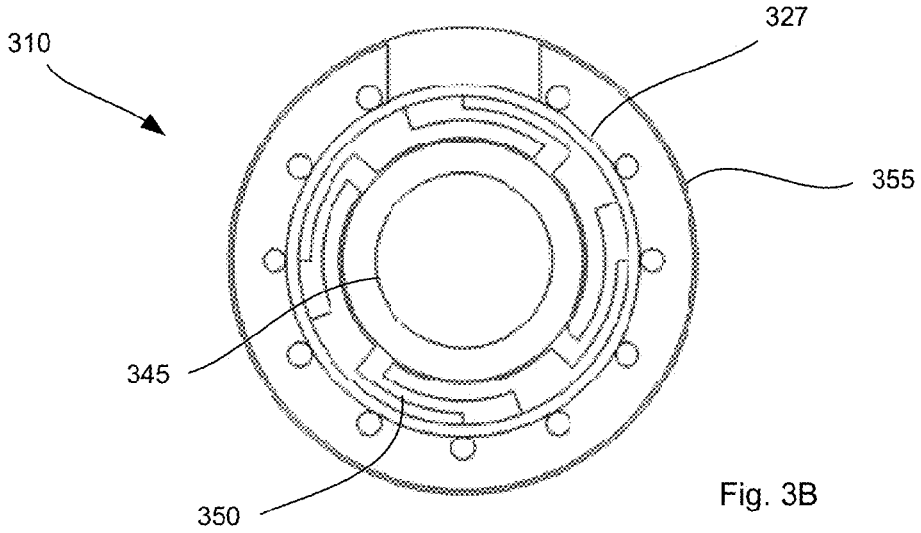
FIG. 3B is a top view of the vibration speaker of FIG. 3A.
Figure 3C:
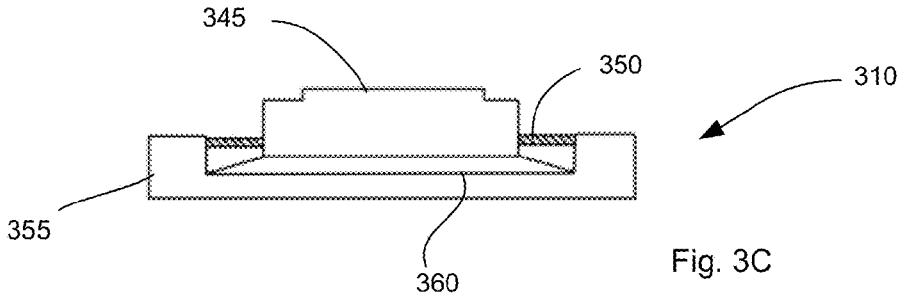
FIG. 3C is a side cross-sectional view of the vibration speaker of FIG. 3A.

Referring to FIGS. 3A-C, an exemplary vibration speaker 310 is shown. The vibration speaker 310 includes the permanent magnet 345 that floats or is suspended from the base 355 by way of a suspension system 350 (which, in this example, is a spider structure). The vibration speaker 310 also includes the diaphragm 360 that is mechanically linked to the coil 327. Vibrations of the permanent magnet 345 occur at particular frequencies of the signal 125, and these vibrations are transferred to the suspension system 350 and to the base 355.

The permanent magnet 345 can be made of any material that can be permanently magnetized. Thus, for example, the magnet 345 can be made of a rare earth material such as neodymium or it can be made of a nonmetallic, ceramic-like ferromagnetic compound such as ferric oxide or ferrite. The suspension system 350 can be made of a material that is elastic; examples of the material used in the suspension system 350 include plastic and metal. The suspension system 350 can be adjusted to have a particular elasticity that depends on the materials used and on the weight and material of the magnet 345 that it suspends.

Figure 4A:
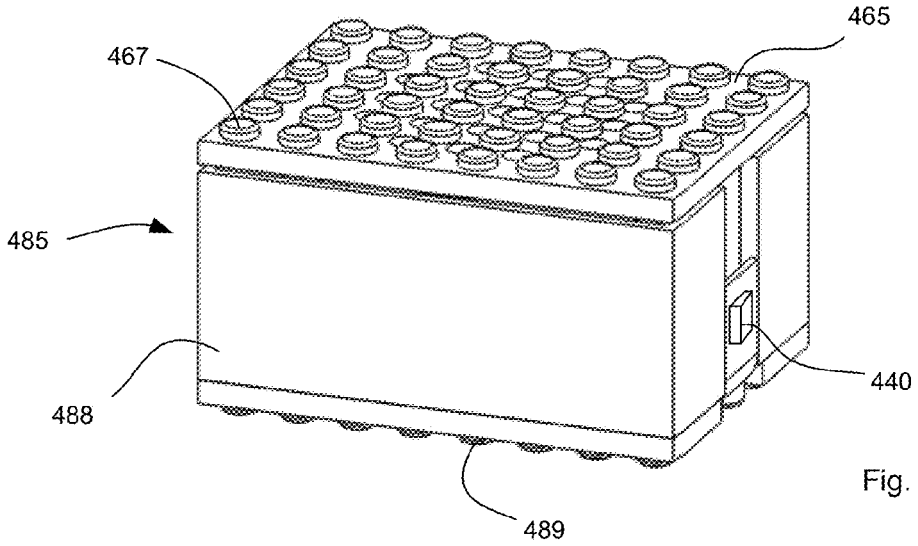
FIG. 4A is a perspective view of a self-contained apparatus that includes the vibration speaker and other components of the toy construction system of FIGS. 1, 2A, and 2B.
Figure 4B:
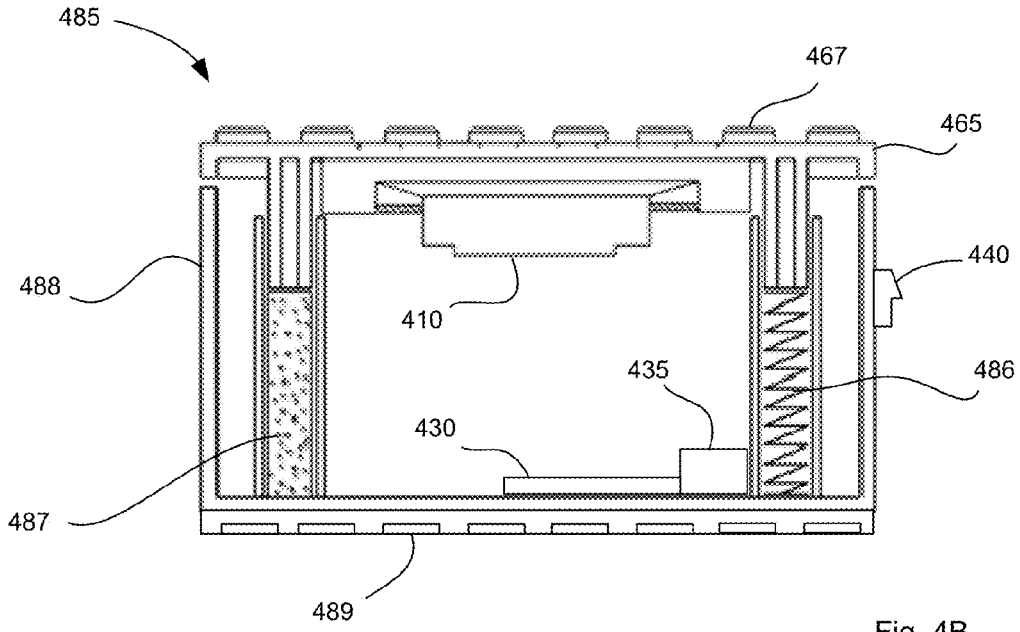
FIG. 4B is a side cross-sectional view of the self-contained apparatus of FIG. 4A.

Referring to FIGS. 4A and 4B, and as mentioned above, in some implementations, the vibration speaker 110, the support building element 165, the control system 130, the one or more switches 140, and the energy source 135 can be configured within an exemplary self-contained apparatus 485. In this example, the support building element 465 and the vibration speaker 410 are suspended by a suspension 486 or 487 over a base 488, which houses the control system 430 and the energy source 435. The suspension 487 is a porous structure such as foam and the suspension 486 is a solid/pliable structure such as a spring. Either or both of these types of suspensions can be used to suspend the support building element 465 and the vibration speaker 410 above the base 488 to enable the free movement of these components. Other types of suspension structures are possible. In any case, the suspension 486 or 487 enables the vibrations 105 from the vibration speaker 410 to be freely transmitted to the support building element 465. The base 488 can also include one or more coupling mechanisms 489 such as recesses for interconnecting with other building elements of the construction set 117.

Referring to FIGS. 5A and 5B, an exemplary self-contained motion converter apparatus 570 is designed as a building element that can be connected with other building elements of the construction set 117. In this example, the motion converter apparatus 570 includes a first building element 571, a second building element 573, and a plurality of bristles 575 between the first building element 571 and the second building element 573. The first and second building elements are moveable relative to each other along a unidirectional path, yet they are also constrained such that they cannot move along paths other than the unidirectional path (for example, along a direction perpendicular to the unidirectional motion that defines the unidirectional path). In this particular example, the second building element 573 is rotatable relative to the first building element 571 about the axis 501 but the second building element 573 is not translatable relative to the first building element 571 along the direction of the axis 501 by more than enough distance to enable this free rotation between the elements 571, 573.

The first building element 571 includes coupling mechanisms such as recesses 576 that enable the element 571 to be interconnected with other building elements of the construction set 117. The first building element 571 also includes a first receiving surface 572 that faces the bristles 575. The first building element 571 includes a first connector 577 positioned such that the axis 501 intersects the center of the first connector 577. The first connector 577 enables attachment between the first building element 571 and the second building element 573, as discussed below. The first building element 571 is the element that is in contact with and constrained by the tactile vibrations 105 so that the first building element 571 vibrates with the tactile vibrations 105.

The second building element 573 includes coupling mechanisms such as studs 578 that enable the element 573 to be interconnected with other building elements of the construction set 117. The second building element 573 also includes a second receiving surface 574 that faces the first building element 571, and a second connector 579 that mates with the first connector 577 to enable the relative motion of the elements 573, 571 along the unidirectional path but to constrain the elements 573, 571 along directions perpendicular to the unidirectional path.

The bristles 575 are slanted at a first angle relative to a neutral position or axis, which, in this particular example, extends along the axis 501. Each of the bristles 575 makes contact at its first free end with the first receiving surface 572 such that the tactile vibrations 105 transmitted to the first building element 571 are transmitted to the first ends of the bristles 575. Moreover, the second ends of the bristles 575 are constrained by the second receiving surface 574 so that as the second ends of the bristles 575 move, the second receiving surface 574 moves. In this particular example, the second ends of the bristles 575 are fixed to a top plate 537, which is fixed to the second receiving surface 574. In other implementations, the second ends of the bristles 575 are fixed directly to the second receiving surface 574.

Thus, when the first building element 571 vibrates, the slanted bristles 575 are forced to vibrate, and the amplitude of the vibration periodically bends the bristles 575 at the frequency of the vibration. As the bristles 575 snap back from being bent, the bristles 575 are forced into a unidirectional motion that depends on the angle at which the bristles 575 are slanted relative to the neutral axis, which is the axis 501. In this example, the unidirectional motion is a circular motion; the slanted bristles 575 rotate about the axis 501 and cause the second building element 573 (which is constrained by the motion of the second ends of the bristles 575) to also rotate about the second axis 501. The direction of rotation depends on the angle at which the bristles 575 are slanted relative to the neutral axis which is the axis 501.

Figure 6A:
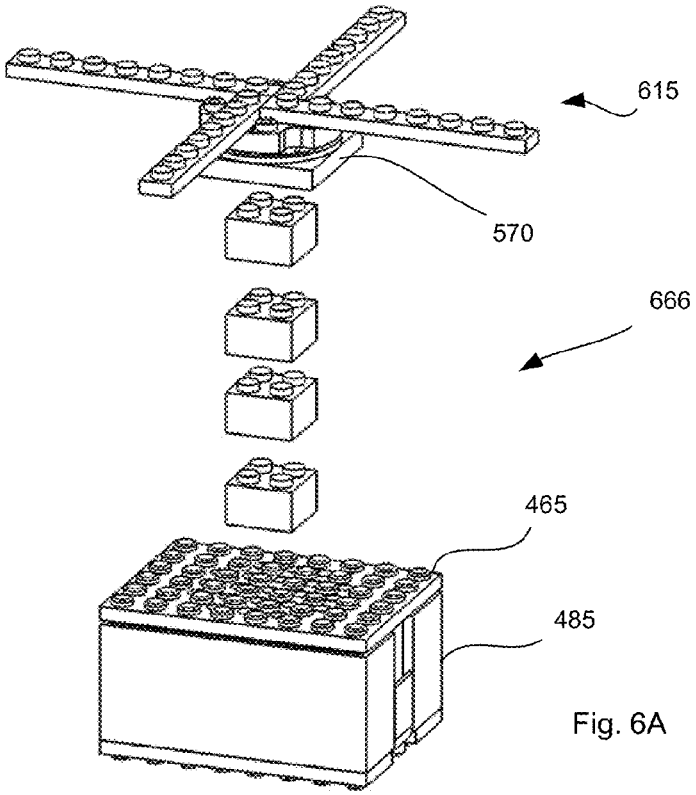
FIG. 6A is an exploded perspective view of an exemplary toy construction system based on the concepts of the system of FIGS. 1, 2A, and 2B.
Figure 6B:
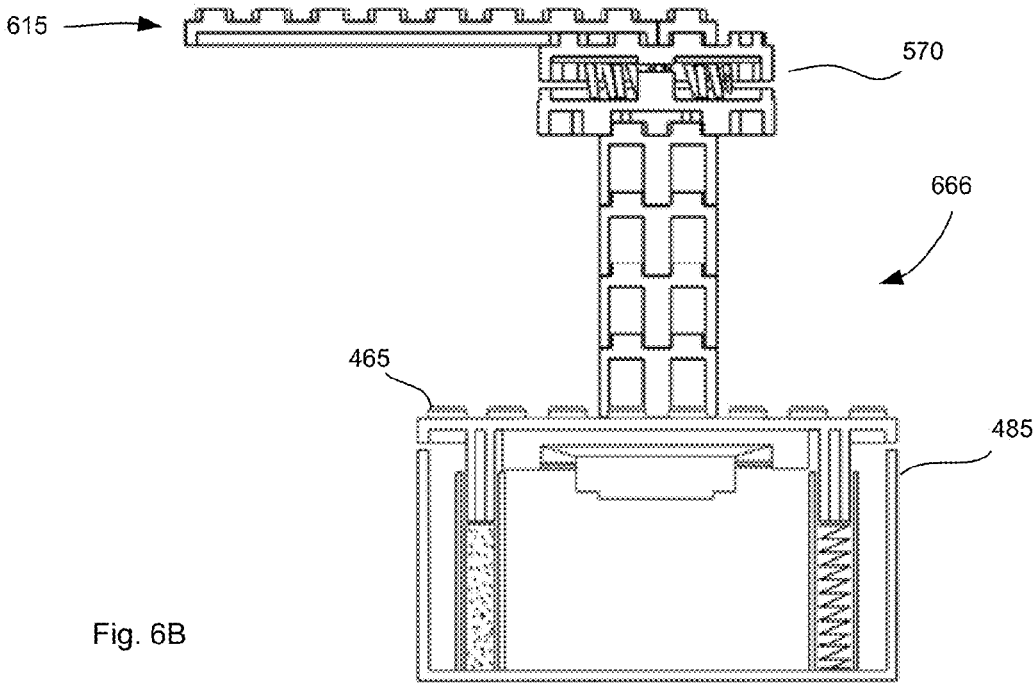
FIG. 6B is a side cross-sectional view of the exemplary toy construction system of FIG. 6A.
Figure 6C:
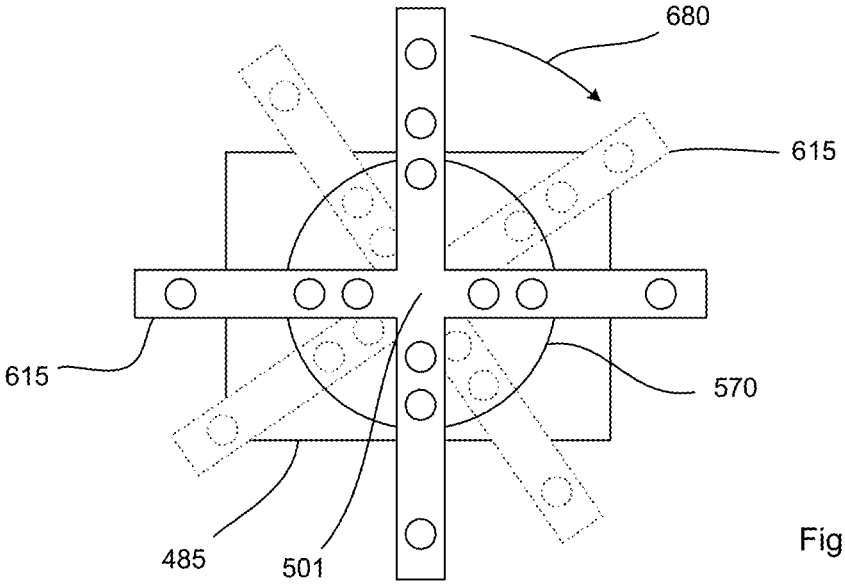
FIG. 6C is a top plan view of an arrangement of building elements and a motion converter apparatus of the exemplary toy construction system of FIGS. 6A and 6B.

Referring also to FIGS. 6A-6C, an exemplary toy construction system is shown that includes the self-contained apparatus 485 that houses the control system 430, the one or more switches 440, and the energy source 435 and suspends the vibration speaker 410 and the support building element 465. In this example, an arrangement 666 includes four 2×2 building elements mechanically connected to the support building element 465. The motion converter apparatus 570 is mechanically connected to the top building element of the arrangement 666 to convert the vibrations 105 produced by the vibration speaker 410 within the apparatus 485 into a circular unidirectional motion 680 that causes an arrangement 615 of building elements to rotate about the central axis 501 of the apparatus 570. In this example, the arrangement 615 is designed to resemble a rotor system of a helicopter. The building elements of the arrangement 615 include coupling mechanisms such as studs for connection to other elements of the toy construction set 117.

Figure 7C:
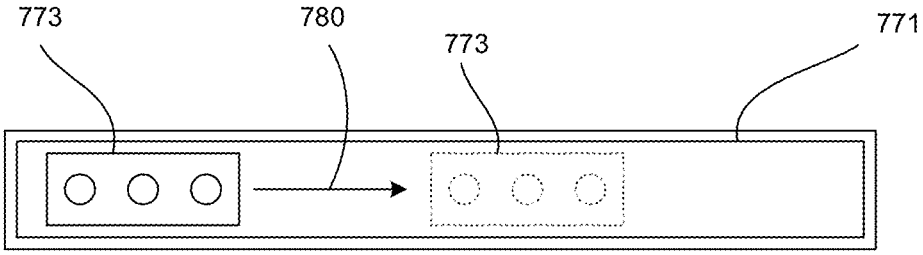
FIG. 7C is a top plan view of an arrangement of building elements and a motion converter apparatus of the exemplary toy construction system of FIGS. 7A and 7B.
Figure 7A:
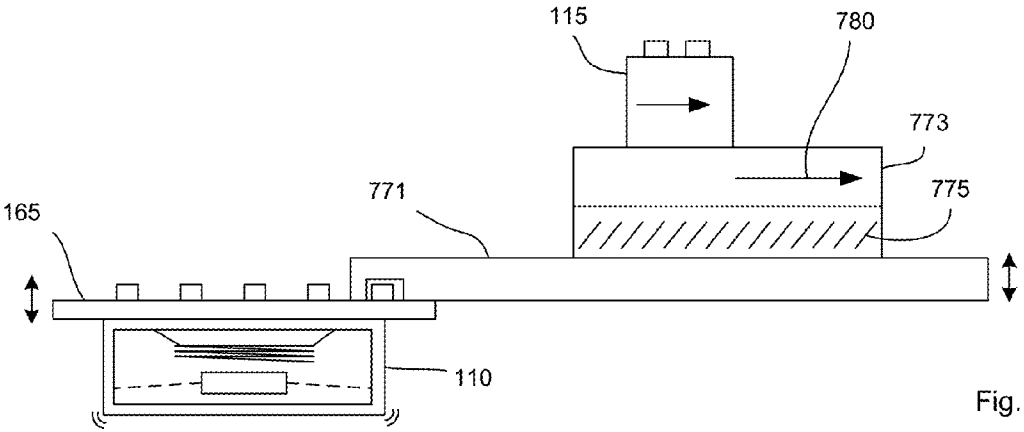
FIGS. 7A and 7B are side views of an exemplary toy construction system based on the concepts of the system of FIGS. 1, 2A, and 2B.
Figure 7B:
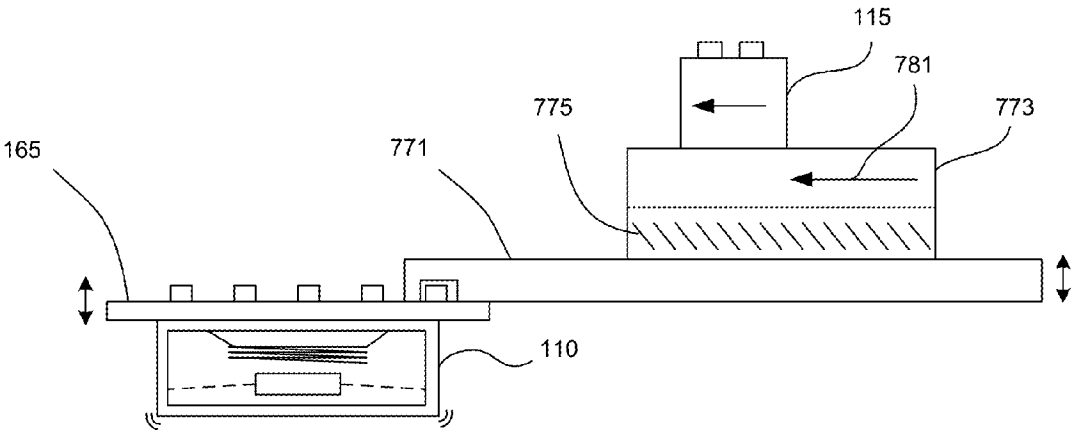

Referring to FIG. 7A, in one implementation, the vibrations 105 from the vibration speaker 110, which are transmitted through the support building element 165, are transmitted to a remote location by way of an elongated building element 771, which can be considered as the first element 271 of the motion converter apparatus 170. In this case, the bristles 775 are positioned next to and contacting the elongated building element 771 to thereby convert the vibrations 105 into a first unidirectional motion 780 of a second element 773, which is then transmitted to the arrangement of building elements 115. As shown in FIG. 7B, if the angle of the bristles 775 is reversed, then the vibrations 105 are converted into a second unidirectional motion 781 of the second element 773. In this way, the vibrations 105 that can be produced by the vibration speaker 110 at one location of the construction system 100 can be transmitted across various elements of the system 100 to a remote position at another distinct location of the construction system 100.

In this particular example, as more clearly shown in FIG. 7C, the elongated building element 771 may have a smooth surface over which the bristles 775 are placed; and the bristles 775 can be in a rectangular arrangement such that the vibrations 105 cause the bristles 775 and also the second element 773 to move along a linear unidirectional path 780.

Figure 8:
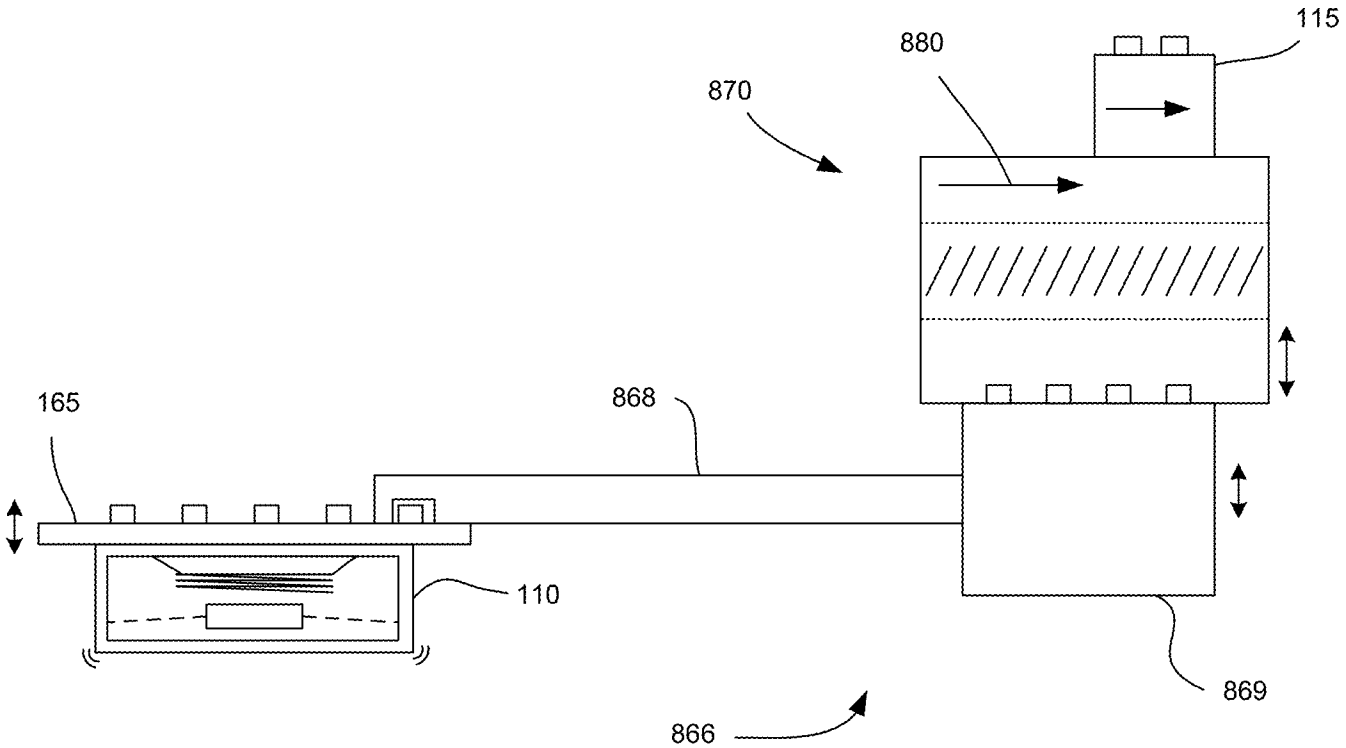
FIG. 8 is a side view of an exemplary toy construction system based on the concepts of the system of FIGS. 1, 2A, and 2B.

Referring to FIG. 8, in another implementation, the vibrations from the vibration speaker 110, which are transmitted through the support building element 165, are transmitted to a remote location by way of an arrangement 866 that includes an elongated building element 868 that is interconnected with the support building element 165, and a box-like building element 869 that is interconnected or joined with the elongated building element 868. Moreover, a motion converter apparatus 870 is mechanically linked with the box-like building element 869 and the arrangement of building elements 115 is interconnected with the motion converter apparatus 870. In this particular implementation, the vibrations 105 produced by the vibration speaker 110 are transmitted through the arrangement 866, namely, through the elongated building element 868 and the box-like building element 869, which is remote from the support building element 165. The motion converter apparatus 870 converts the vibrations 105 into the unidirectional motion 880, which is transmitted to the building elements 115.

Figure 9A:
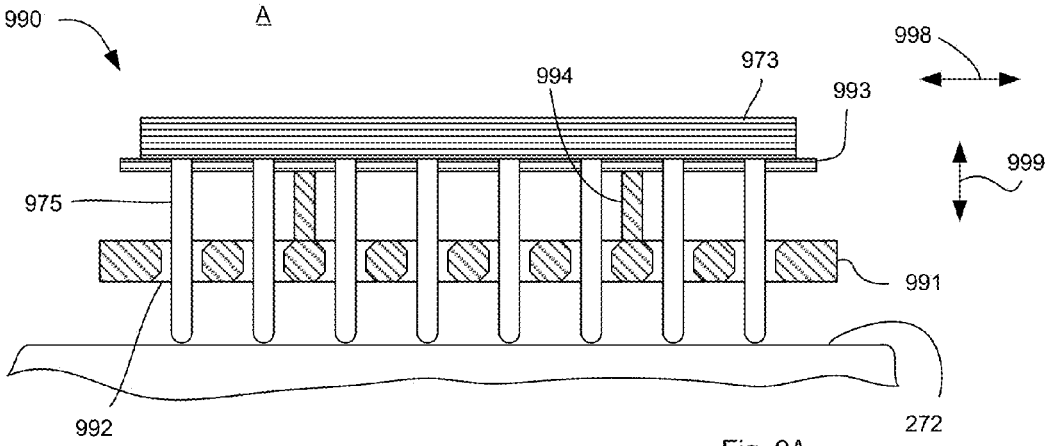
FIGS. 9A-9C are side cross-sectional views of an exemplary reversible bristle device that can be used in the toy construction systems of FIGS. 1, 2A, and 2B.
Figure 9B:
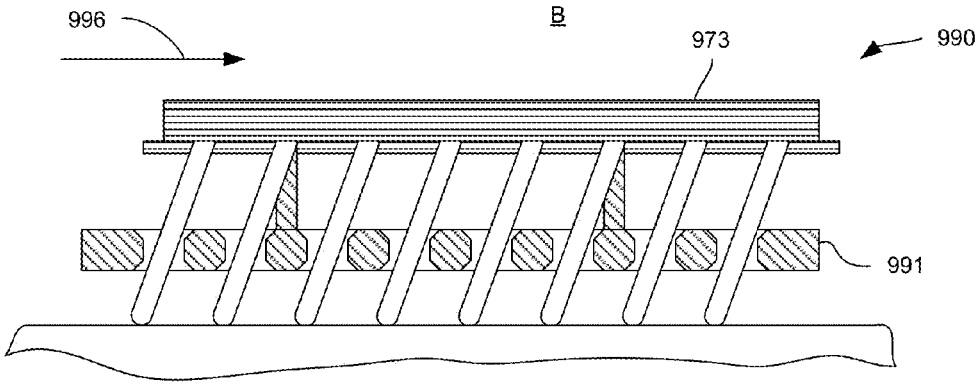
Figure 9C:
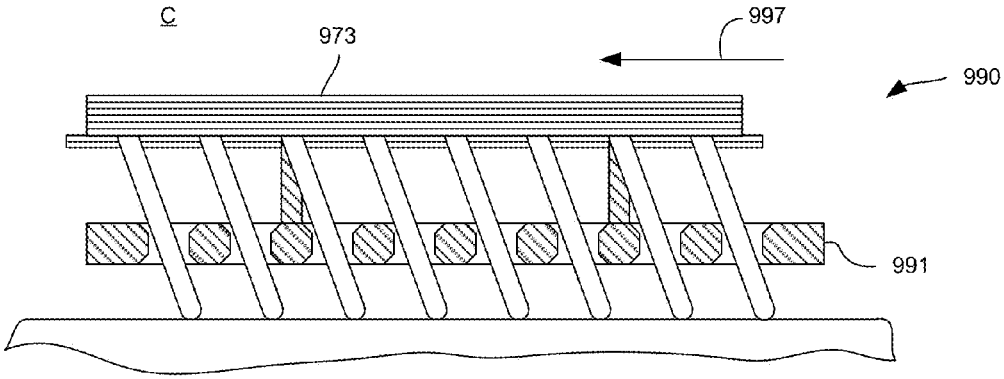

Referring to FIGS. 9A-9C, the bristles of the motion converter apparatus 170 can be incorporated into a reversible bristle device 990 that includes a set of slantable bristles 975 unconstrained at a first end while fixed at a second end to a cap 973, which serves the same purpose as the second element 273 detailed above. The cap 973 is moveable relative to a base 991 along a first path 998 away from or toward a neutral position A (shown in FIG. 9A) and that is constrained relative to the base 991 along a second path 999 that is perpendicular to the first path. The neutral position A is a position in which the bristles 975 are unslanted relative to the first receiving surface 272 (which is shown in FIG. 9A), which is the vibrating surface that the bristles 975 contact to enable motion conversion. In other words, in the neutral position A, the bristles 975 are normal to the plane of the first receiving surface 272.

The base 991 has a plurality of through holes 992 through which the first end of the bristles 975 extend. As mentioned above, the cap 973 is constrained relative to the base along the second path 999 so that the cap 973 and the base 991 can be held together as a self-contained unit. To enable this, the cap 973 and the base 991 include mating connection mechanisms. For example, the cap 973 can include a flange 993 and the base 991 can include clips 994 that extend above the flange 993 so that the cap 973 is unable to move a significant amount along the second path 999. Some motion along the second path 999 may be needed to enable the cap 973 to move freely relative to the base 991 along the first path 998.

As shown in FIG. 9B, the cap 973 can be moved relative to the base 991 along a first direction 996 of the first path 998 to a position B and fixed in position B relative to the neutral position A. In position B, the bristles 975 are slanted in a first manner relative to the neutral direction (which extends along the second path 999). Thus, while in position B, the bristles 975 of the bristle device 900 act to convert vibrations 105 applied to the first receiving surface 272 into a first unidirectional motion (which would actually be in the first direction 996). As shown in FIG. 9C, the bristle device 900 can be reversed so that the bristles 975 convert the vibrations 105 applied to the first receiving surface 272 into a second unidirectional motion that is opposite to the first direction 996. In FIG. 9C, the cap 973 is moved relative to the base 991 along a second direction 997 of the first path 998 to a position C and then fixed in position C. In position C, the bristles 975 are slanted in a second manner relative to the neutral direction. In this way, the motion conversion direction of the bristle device 900 is easily reversed by moving the cap 973 relative to the base 991.

The cap 973 may or may not include coupling mechanisms (such as studs) for connecting to building elements of the construction set 117. While such coupling mechanisms are not shown in FIGS. 9A-9C, they are included in the design of FIGS. 10A-10D.

The bristles 975, the cap 973, and the base 991 can be designed to convert the vibrations 105 into a linear unidirectional motion; in this particular case, the bristles 975, the cap 973, and the base 991 would have a rectangular geometry.

The reversible bristle device 990 can also include a fixation apparatus for fixing the base 991 at a particular position or angle relative to the cap 973 and thus ensure that the bristles 975 are held at a certain angle. The fixation apparatus can be a frictional engagement between the base 991 and the cap 973. For example, one of the base 991 and the cap 973 can include detents and the other of the base 991 and the cap 973 can include a pressure activated latch. As another example, one of the base 991 and the cap 973 can include a keyed-out area and the other of the base 991 and the cap 973 can include an extrusion that allows the base 991 to stay at a given angle relative to the cap 973.

In other implementations, and with reference to FIGS. 10A-10D, the reversible bristle device 1090 is designed to convert the vibrations 105 into a rotational or circular motion. In the bristle device 1090, the bristles 1075, the cap 1073, and the base 1091 have circular geometries. The reversible bristle device 1090 also includes a plate 1095 that is mechanically linked to the cap 1073 so that the plate 1095 moves as the cap 1073 moves relative to the base 1091 along the first path 1098 away from or toward the neutral position (which is the position shown in FIGS. 10A-10D). The bristles 1075 are connected to the plate 1095 at their second ends to enable the fixation between the second ends of the bristles 1075 and the cap 1073.

Figure 10A:
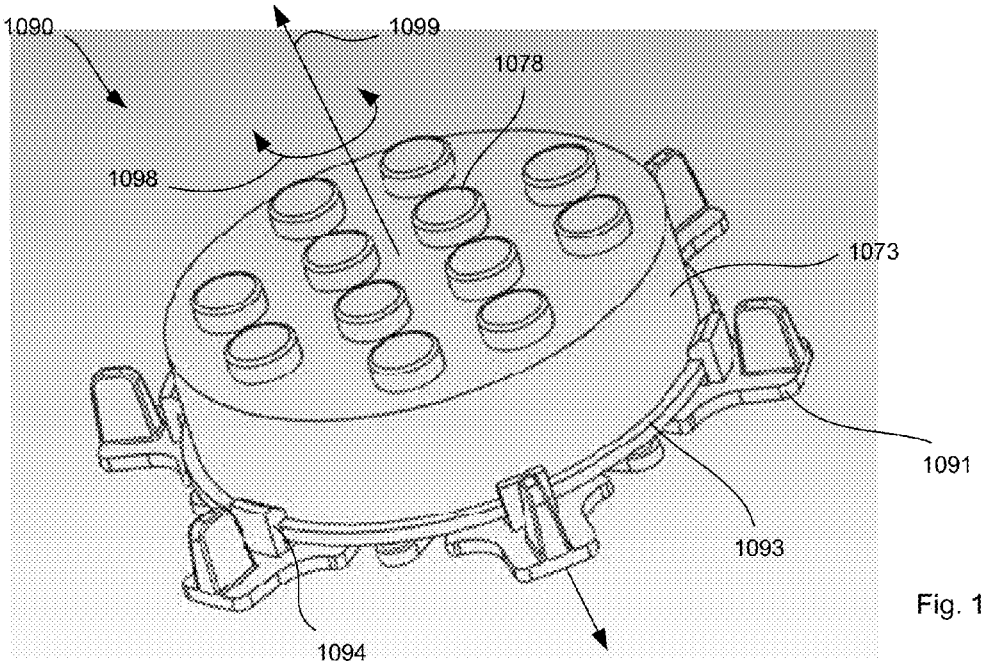
FIG. 10A is a perspective view of an exemplary rotary reversible bristle device based on the designs of FIGS. 9A-9C.
Figure 10B:
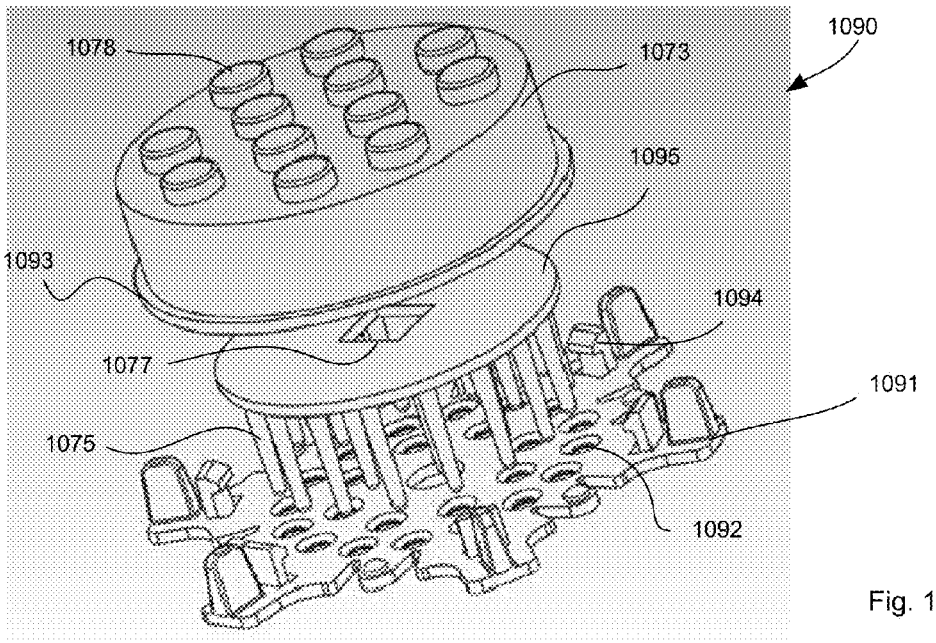
FIG. 10B is an exploded perspective view of the reversible bristle device of FIG. 10A.
Figure 10C:
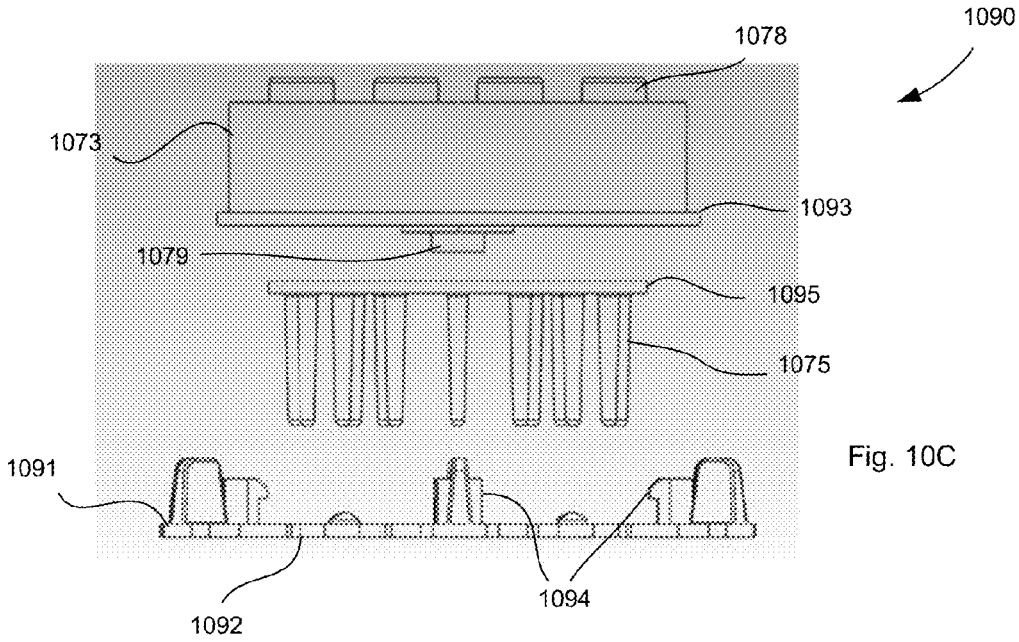
FIG. 10C is an exploded side view of the reversible bristle device of FIG. 10A.
Figure 10D:
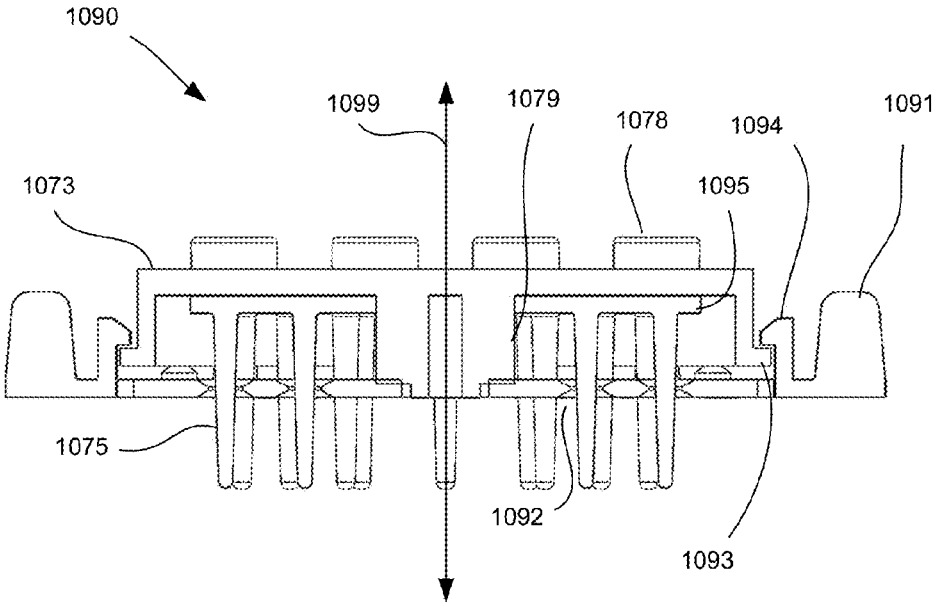
FIG. 10D is a side cross-sectional view of the reversible bristle device of FIG. 10A.

The plate 1095 can be mechanically linked to the cap 1073 using one or more of adhesive or bonding agents, connection devices, and a frictional engagement. For example, as shown in FIGS. 10B-10D, the plate 1095 includes an opening 1077 through which a peg 1079 of the cap 1073 is inserted, and the size of the cross-sectional shape of the peg 1079 is complementary to the size of the plate opening 1077 to enable a frictional engagement between the plate 1095 and the peg 1079 to thereby constrain the movement of the plate 1095 to the movement of the peg 1079 and the cap 1073 to which the peg 1079 is attached. In the bristle device 1090, the cap 1073 includes coupling mechanisms such as studs 1078 for connecting to building elements of the construction set 117.

The bristle device 1090 is shown in the neutral position in FIGS. 10A-10D. To active the bristle device 1090 to convert vibrations 105 applied to the first receiving surface 272 into a circular or rotational motion, the cap 1073 is rotated relative to the base 1091 along the first path 1098 away from the neutral position (for example, using counterclockwise motion). The circular motion can be reversed by rotating the cap 1073 relative to the base 1091 along the first path 1098 using a clockwise motion. In this way, the bristle device 1090 can be easily manipulated to reverse the unidirectional motion produced by the motion converter apparatus 170.

Figure 11A:
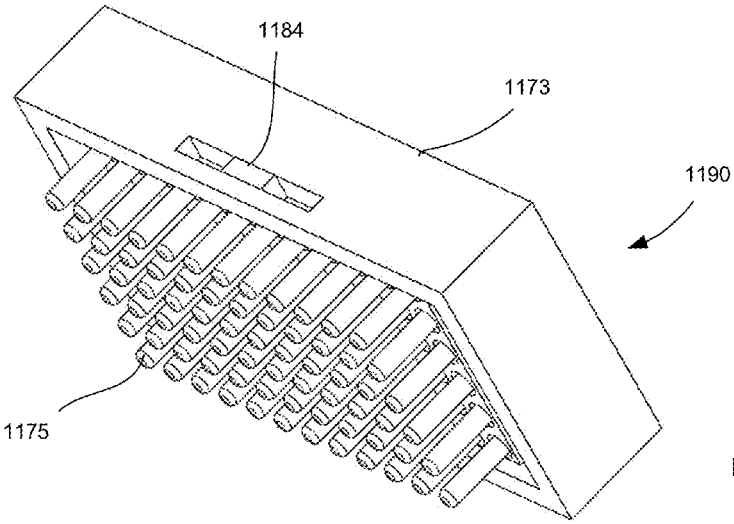
FIG. 11A is a perspective view of an exemplary linear reversible bristle device based on the designs of FIGS. 9A-9C.
Figure 11B:
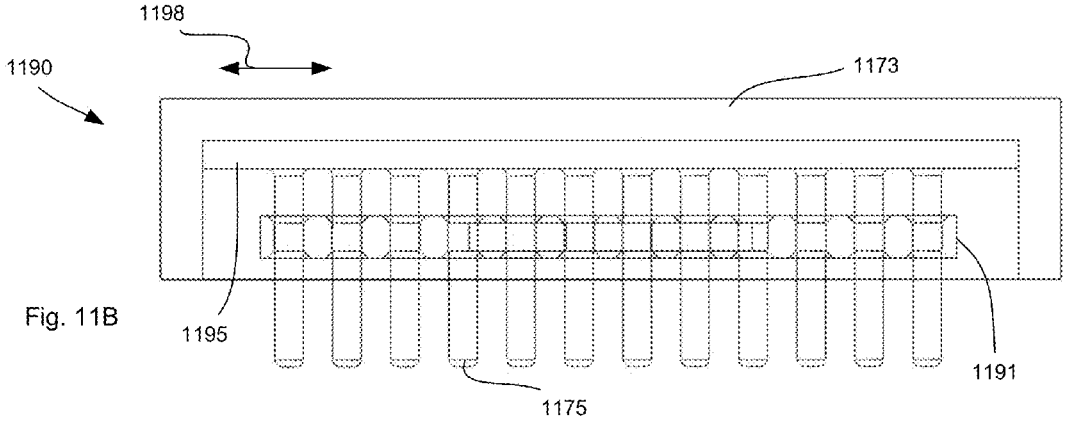
FIG. 11B is a side cross-sectional view of the reversible bristle device of FIG. 11A.
Figure 11C:
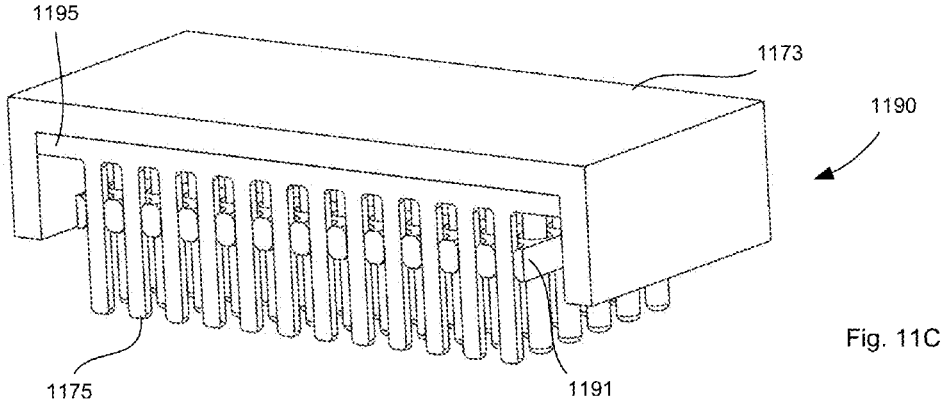
FIG. 11C is a perspective view of a cross-section of the reversible bristle device of FIG. 11A.
Figure 12A:
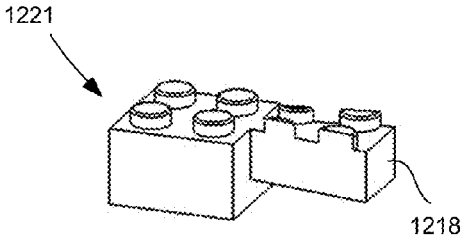
FIG. 12A is a perspective top view of a male building element that can be used in the toy construction systems of FIGS. 1, 2A, 2B, 4A, 4B, 6A, 6B, 7A, 7B, and 8.
Figure 12C:
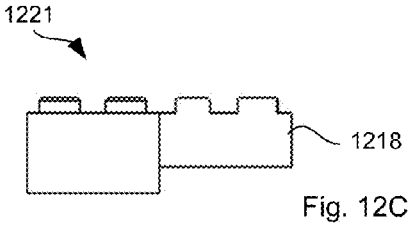
FIG. 12C is a side view of the male building element of FIG. 12A.
Figure 12B:
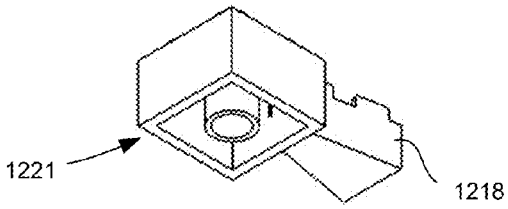
FIG. 12B is a perspective bottom view of the male building element of FIG. 12A.
Figure 12D:
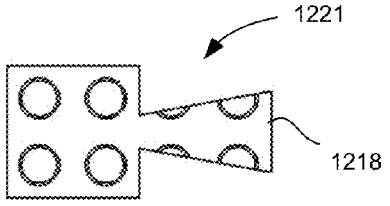
FIG. 12D is a top view of the male building element of FIG. 12A.
Figure 13C:
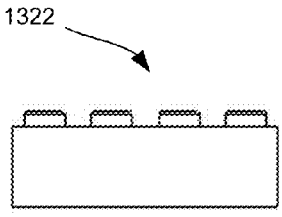
FIG. 13C is a side view of the female building element of FIG. 13A.
Figure 13A:
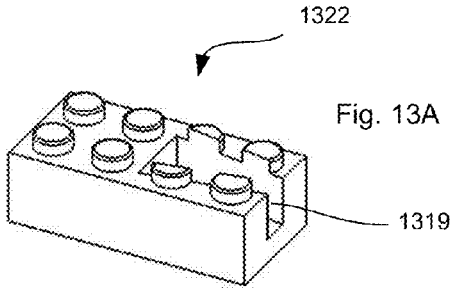
FIG. 13A is a perspective top view of a female building element that can be used in the toy construction systems of FIGS. 1, 2A, 2B, 4A, 4B, 6A, 6B, 7A, 7B, and 8 and that can mate with the male building element of FIGS. 12A-12D.
Figure 13D:
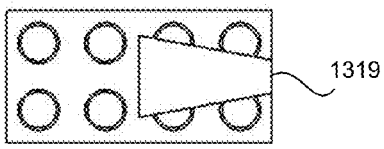
FIG. 13D is a top view of the female building element of FIG. 13A.
Figure 13B:
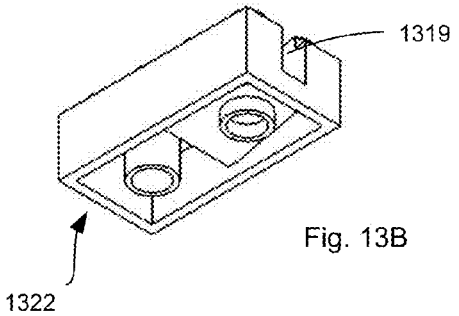
FIG. 13B is a perspective bottom view of the female building element of FIG. 13A.

In other implementations, and with reference to FIGS. 11A-11C, the reversible bristle device 1190 is designed to convert the vibrations 105 into a linear motion. In the bristle device 1190, the bristles 1175, the cap 1173, and the base 1191 have rectangular geometries. The reversible bristle device 1190 also includes a plate 1195 that is mechanically linked to the cap 1173 so that the plate 1195 moves as the cap 1173 moves relative to the base 1191 along the first path 1198 away from or toward the neutral position (which is the position shown in FIGS. 11A-11C). The bristles 1175 are connected to the plate 1195 at their second ends to enable the fixation between the second ends of the bristles 1175 and the cap 1173.

The plate 1195 can be mechanically linked to the cap 1173 using one or more of adhesive or bonding agents, connection devices, and a frictional engagement. While not show, the cap 1173 can include coupling mechanisms such as studs for connecting to building elements of the construction set 117.

The bristle device 1190 is shown in the neutral position in FIGS. 11A-11C. To active the bristle device 1190 to convert vibrations 105 applied to the first receiving surface 272 into a linear motion, the cap 1173 is translated relative to the base 1191 along the first path 1198 away from the neutral position (for example, to the right of the page of the drawing) by moving a knob 1184, which is mechanically linked to the base 1191, relative to the cap 1173. As the knob 1184 is moved along the first path 1198 (to the right of the page), the base 1191 moves because the base 1191 is constrained by the knob 1184, for example, by a direct connection between the base 1191 and the knob 1184. The linear motion can be reversed by moving the knob 1184 along the first path 1198 in the opposite direction, for example, to the left of the page, relative to the cap 1173. In this way, the bristle device 1190 can be easily manipulated to reverse the unidirectional motion produced by the motion converter apparatus 170.

As discussed above, vibrations 105 produced by the vibration speaker 110 are transmitted through the support building element 165, and to the motion converter apparatus 170. The vibrations 105 can be mechanically transmitted through each of the building elements of the arrangement 266 to the motion converter apparatus 170. The mechanical transmission can be performed through the coupling mechanisms of the building elements. Thus, it is the connection between the coupling mechanisms of adjacent building elements that transfers the vibrations 105 between the adjacent building elements. In some implementations, a special mechanical joint can be incorporated into one or more building elements in the toy construction system 100 to enable the mechanical transmission of the vibrations 105 from any one of the building elements to another building element.

For example, with reference to FIGS. 12A-12D and 13A-13D, one particular joint is a male and female dovetail; in which the male dovetail 1218 is formed on the building element 1221 and the female dovetail 1319, which interfits with the male dovetail 1218, is formed in the building element 1322. The joint can be formed into the building elements by injection molding.

Referring to FIG. 14A, a close-up of one of the bristles 275 is shown fixed or constrained to the second element 273 and in the neutral position 201. As discussed above, the bristles 275 can be set at an acute angle relative to the neutral position 201; the angle selected determines how the second element 273 will move in response to the vibrations 105 imparted to the first element 271. Thus, as shown in FIG. 14B, the bristle 275 is at an angle $\Theta_1$ from the neutral position 201 and as shown in FIG. 14C, the bristle 275 is at an angle $\Theta_2$ from the neutral position 201. The angle selected can be any value from 0° (at the neutral position 201) just below 90° (which is close to being flat against the surface of the second element 273). Additionally, as discussed in more detail below with respect to FIGS. 15A-15C, 16, and 17, the motion converter apparatus 170 can include bristles 275 having variable angles to achieve different results in the motion produced at the second element 273.

The length $L_B$ of the bristles 275 can be selected based on the geometry of the motion converter apparatus 170, and also can be selected based on the desired motion to impart to the second element 273. Thus, for example, as shown in FIG. 14D, a shorter length $L_B$ for the bristles 275 could impart a slower (low speed) motion or a shorter distance of motion to the second element 273 while, as shown in FIG. 14E, a longer length $L_B$ for the bristles 275 could impart a faster (high speed) motion or a longer distance of motion to the second element 273. Moreover, the bristles 275 of the motion converter apparatus 170 can be designed to have variable lengths, to achieve different results in motion produced at the second element 273.

Moreover, while the bristles 275 can have a linear or straight geometry (as shown in FIG. 14A) when in the neutral position 201 (and when not receiving any force from the first element 271), other geometries for the bristles 275 can be used either alone or in combination with linear geometries. For example, the bristles 275 can have a non-linear geometry, such as the curved geometry shown in FIG. 14F, when in the neutral position 201 and when not receiving any force from the first element 271.

In some implementations, the angles, geometries, and the lengths of each of the bristles 275 of the motion converter apparatus 170 can be identical to each other. However, it is possible to use different or variable angles, different or variable lengths, and different or variable geometries for the bristles 275 in a single motion converter apparatus 170.

Additionally, while we have described bristle 275 arrangements that have simple geometric shapes such as circles and rectangles, which are easily described using mathematics, the arrangement of bristles 275 could be non-geometric or complex geometries (which would not be easily described using mathematics). Additionally, the arrangement of bristles 275 could be selected or designed to produce a sequence of unidirectional motions or a random, non-vibratory motion.

Figure 15A:
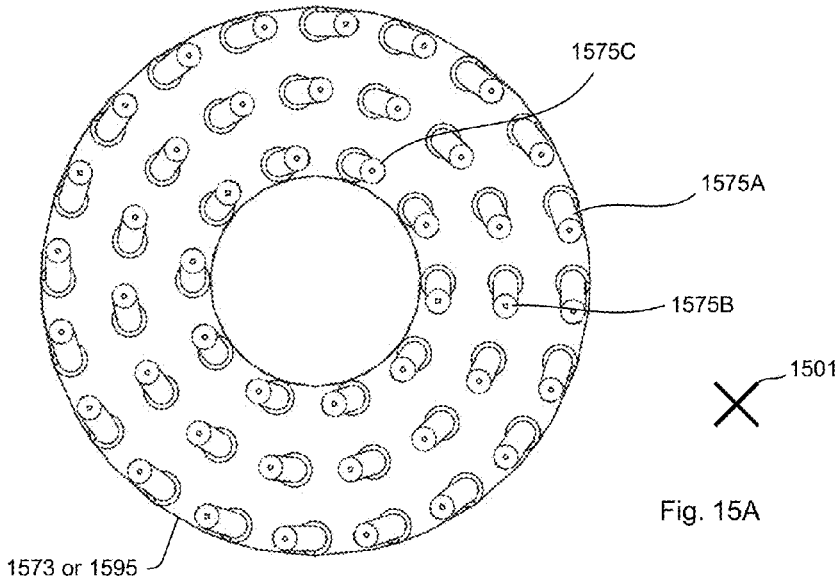
FIG. 15A is a bottom plan view of an exemplary circular bristle arrangement of a motion converter apparatus that can be used in the toy construction systems of FIGS. 1, 2A, 2B, 4A, 4B, 6A, 6B, 7A, 7B, and 8.
Figure 15B:
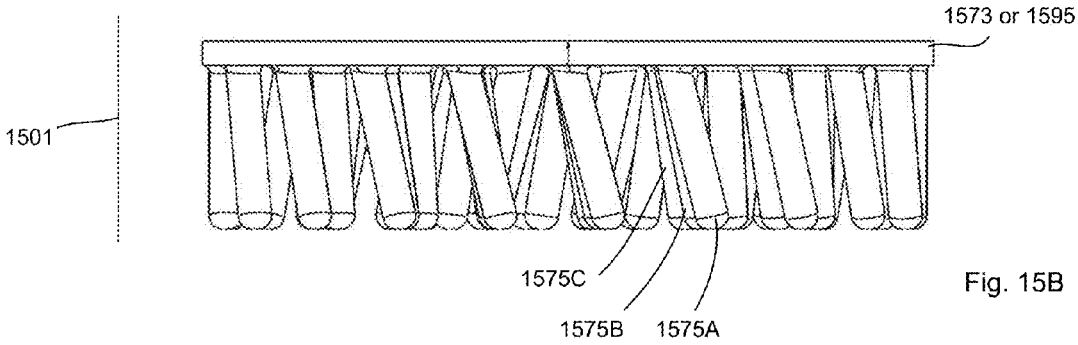
FIGS. 15B and 15C are side views of the exemplary bristle arrangement of FIG. 15A.
Figure 15C:
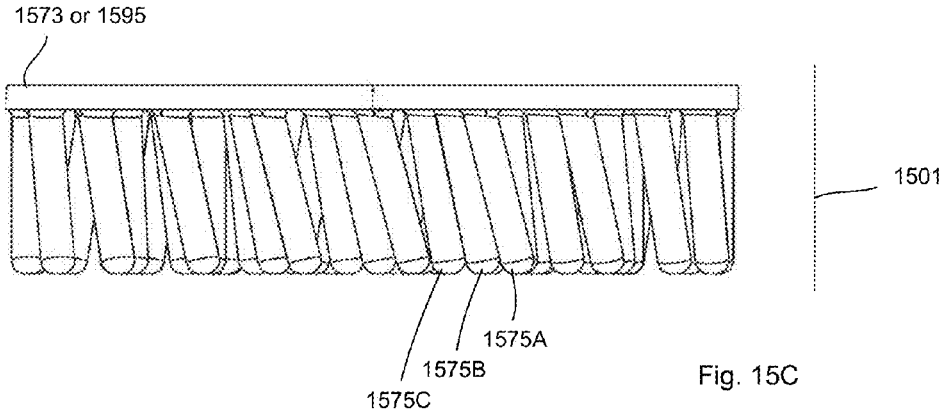

Referring to FIGS. 15A-15C, an exemplary circular arrangement of bristles 1575 is shown in its natural environment (thus, the first element 271 is not applying any force to the bristles 1575). The arrangement includes three sets of bristles, 1575A, 1575B, and 1575C, with each set being on a concentric circle having a distinct radius and all of the bristles of every set being constrained by the motion of the monolithic second element 1573 (or the monolithic plate 1595 if a plate is used). The bristles in set 1575A are naturally slanted at an angle $\Theta_A$, the bristles in set 1575B are naturally slanted at angle $\Theta_B$, and the bristles in set 1575C are naturally slanted at angle $\Theta_C$, these angles given relative to the neutral position 1501, which is shown going into the page in FIG. 15A. Thus, for example, the angle $\Theta_A$ is greater than the angle $\Theta_A$, which is greater than the angle $\Theta_C$. By adjusting the angle at which the bristles 1575 of the arrangement are naturally set, the motion imparted to the second element 273 can be adjusted, for example, to impart the motion more efficiently to the second element 273.

Referring to FIG. 16, another exemplary circular arrangement of bristles 1675 is shown in its natural environment (thus, the first element 271 is not applying any force to the bristles 1575). The arrangement includes three sets of bristles, 1675A, 1675B, and 1675C, with each set being on a concentric circle having a distinct radius and the bristles of each set being constrained by the motion of a respective partition or segment 1673A, 1673B, 1673C of the second element 1673 (or the segments of a plate 1695 if a plate is used). Each segment 1673A, 1673B, 1673C of the second element 1673 can move independently about the center of the circular arrangement while being constrained along the axial direction. In some implementations, the bristles in each of the sets 1675A, 1675B, 1675C can be naturally slanted at distinct angles, or can have distinct lengths or geometries. In other implementations, the bristles in all of the sets 1675A, 1675B, 1675C can be naturally slanted at the same angles. By segmenting the second element 1673 (and the bristle sets 1675A, 1675B, 1675C constrained by each segment of the second element 1673), it is possible to create distinct unidirectional motions in the second element 1673. For example, the segment 1673A could move more slowly than the segments 1673B and 1673C. Or, if the angles of the bristles in distinct sets are in different directions, then it could be configured to move the segment 1673B along a unidirectional path 1681B that is the opposite to the paths 1680A, 1680C, taken by respective segments 1673A and 1673C (as shown in FIG. 16).

Referring to FIG. 17, this concept of a segmented bristle arrangement and a corresponding segmented second element can be applied to a rectangular geometry. In this case, the bristles 1775 are segmented into sets 1775A and 1775B, which are respectively constrained by second element segments 1773A and 1773B. In this way, it might be possible to impart a non-linear (for example, circular) unidirectional motion 1780 to the rectangular bristle/second element geometry.

Other implementations are within the scope of the following claims. While many alterations and modifications of the present disclosure will become apparent to a person of ordinary skill in the art after having read the foregoing description, it is to be understood that the particular embodiments shown and described by way of illustration are in no way intended to be considered limiting. Further, the disclosure has been described with reference to particular preferred embodiments, but variations within the spirit and scope of the disclosure will occur to those skilled in the art. The foregoing examples have been provided merely for the purpose of explanation and are in no way to be construed as limiting of the present disclosure. While the present disclosure has been described with reference to exemplary embodiments, the words, which have been used herein, are words of description and illustration, rather than words of limitation. Changes can be made, within the purview of the appended claims, as presently stated and as amended, without departing from the scope and spirit of the present disclosure in its aspects. Although the present disclosure has been described herein with reference to particular means, materials, and embodiments, the present disclosure is not intended to be limited to the particulars disclosed herein; rather, the present disclosure extends to all functionally equivalent structures, methods and uses, such as are within the scope of the appended claims.

What is claimed is:

1. A toy construction system comprising:

a plurality of interconnectable building elements;

a control system that generates an electromagnetic signal;

a vibration speaker including:

a permanent magnet that is moveable;

a coil positioned near the permanent magnet and moveable relative to the permanent magnet, the coil configured to receive the electromagnetic signal from the control system such that the coil, the permanent magnet, or both vibrate in a manner that is based on the electromagnetic signal; and a sound producer including a diaphragm that is mechanically linked to the coil to vibrate with the coil as the coil vibrates; and a support building element that is mechanically linked to the permanent magnet of the vibration speaker;

wherein:

the coil vibrates relative to the permanent magnet when the electromagnetic signal includes frequencies within a first frequency range, the vibration of the coil causing the diaphragm to vibrate and produce an audible sound, and the permanent magnet vibrates when the electromagnetic signal includes frequencies within a second frequency range, the vibration of the permanent magnet causing the support building element to vibrate.

2. The system of claim 1, further comprising a bristle module including a bristle pad positioned between a first building element and a second building element, the first building element connectable to the support building element, wherein the vibration of the support building element causes the first building element to vibrate, the vibration of the first building element is converted into a unidirectional movement of the second building element by way of the bristle pad.

3. The system of claim 2, wherein the bristle pad comprises a plurality of slantable bristles extending below a plate, the plate sized to fit within an opening of the second building element and the bristles resting on a top surface of the first building element.

4. The system of claim 3, wherein the plurality of slantable bristles are arranged in a circular pattern to enable a circular unidirectional movement.

5. The system of claim 3, wherein the plurality of slantable bristles are arranged in a linear pattern to enable a linear unidirectional movement.

6. The system of claim 1, further comprising a base building element on which the support building element and the vibration speaker are suspended to enable the support building element to freely vibrate relative to the base building element, wherein the vibration speaker is between the support building element and the base building element.

7. The system of claim 6, wherein the control system is within an enclosure of the base building element.

8. The system of claim 1, wherein the support building element is a platform building element.

9. The system of claim 1, wherein the vibration of the support building element does not require a vibrating mechanism other than the vibration speaker.

10. The system of claim 1, wherein the permanent magnet is suspended by a suspension system relative to a base of the vibration speaker.

11. The system of claim 10, wherein the suspension system is made of an elastic material, a porous structure, or a spring.

12. The system of claim 1, wherein the diaphragm is attached to the coil so that it moves and vibrates with the coil.

13. The system of claim 1, wherein the electromagnetic signal generated by the control system has frequency characteristics within two ranges of frequency, the first range of frequency being below a predetermined tactile frequency value and the second range of frequency being greater than a predetermined audible frequency value.

14. The system of claim 1, further comprising a motion converter apparatus that converts the vibration of the support building element into a unidirectional motion that is transferred into movement of another building element.

15. The system of claim 1, wherein the vibration speaker, the support building element, the control system, and an energy source are in a self-contained apparatus.

16. A toy comprising:

a control system that generates an electromagnetic signal;

a vibration speaker including:

a permanent magnet that is moveable relative to a base;

a coil positioned near the permanent magnet, the coil moveable relative to the permanent magnet, the coil configured to receive the electromagnetic signal from the control system such that both the coil and the permanent magnet vibrate at the same time in manners that are based on the frequencies of the electromagnetic signal; and a sound producer including a diaphragm that is mechanically linked to the coil to move with the coil as the coil moves; and a toy component that is mechanically linked to the permanent magnet;

wherein the simultaneous vibration of the diaphragm and the permanent magnet causes the simultaneous movement of the toy component and the production of audible sound that complements the toy component movement.

17. The toy of claim 16, wherein the simultaneous movement of the toy component and the production of audible sound that complements the toy component movement does not require a vibrating mechanism other than the vibration speaker.

18. The toy of claim 16, wherein the permanent magnet is suspended by a suspension system relative to the base.

19. The toy of claim 18, wherein the suspension system is made of an elastic material, a porous structure, or a spring.

20. The toy of claim 16, wherein the diaphragm is attached to the coil so that it moves and vibrates with the coil.

21. The toy of claim 16, wherein the electromagnetic signal generated by the control system has frequency characteristics within two ranges of frequency, the first range of frequency being below a predetermined tactile frequency value and the second range of frequency being greater than a predetermined audible frequency value.

22. The toy of claim 16, further comprising a support element that is mechanically linked to the permanent magnet of the vibration speaker so that the vibration of the permanent magnet causes the support element to vibrate.

23. The toy of claim 22, further comprising a motion converter apparatus that converts a vibration of the support element into a unidirectional motion that is transferred into the movement of the toy component.

24. The toy of claim 23, wherein the unidirectional motion is a rotational motion in which the toy component travels along a path of a circle.

25. The toy of claim 23, wherein the unidirectional motion is a translatable motion in which the toy component travels along a linear path.

26. The toy of claim 16, wherein tactile vibrations are harnessed into the movement of the toy component from the motion and vibration of the permanent magnet and of the base.

27. The toy of claim 16, wherein the audible sound is produced from the oscillation of pressure in a compressible medium due to the vibration of the diaphragm.

28. A toy comprising:

a control system that generates an electromagnetic signal that includes two sets of signals, a first set of signals that is within a first range of frequency that is below a predetermined tactile frequency value and a second set of signals that is within a second range of frequency that is greater than a predetermined audible frequency value;

a vibration speaker including:

a permanent magnet that is moveable relative to a base;

a coil positioned near the permanent magnet, the coil moveable relative to the permanent magnet, the coil configured to receive the electromagnetic signal from the control system such that both the coil and the permanent magnet vibrate at the same time in manners that are based on the frequencies of the electromagnetic signal; and a sound producer including a diaphragm that is mechanically linked to the coil to move with the coil as the coil moves;

a support element mechanically linked to the permanent magnet of the vibration speaker;

a motion converter apparatus mechanically linked to the support element; and a toy component that is mechanically linked to the motion converter apparatus;

wherein the simultaneous vibration of the diaphragm and the permanent magnet causes the simultaneous movement of the toy component and the production of audible sound that complements the toy component movement, wherein the tactile vibrations of the permanent magnet and the base are harnessed by the motion converter apparatus and converted into the movement of the toy component and the audible sound is produced from the oscillation of pressure in a compressible medium due to the vibration of the diaphragm.

* * * * *